US008389189B2

(12) United States Patent
Shirai et al.

(10) Patent No.: US 8,389,189 B2
(45) Date of Patent: Mar. 5, 2013

(54) RESIN BINDERS FOR TONERS

(75) Inventors: Eiji Shirai, Wakayama (JP); Shoichi Murata, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/038,607

(22) Filed: Mar. 2, 2011

(65) Prior Publication Data

US 2011/0229816 A1 Sep. 22, 2011

(30) Foreign Application Priority Data

Mar. 18, 2010 (JP) ..... 2010-061958

(51) Int. Cl.
*G03G 9/093* (2006.01)
*G03G 9/087* (2006.01)

(52) U.S. Cl. ..... 430/109.4; 430/137.14; 430/110.2

(58) Field of Classification Search ..... 430/109.4, 430/137.14
See application file for complete search history.

(56) References Cited

U.S. PATENT DOCUMENTS 7,951,519 B2 5/2011 Iwazaki et al.
2006/0105258 A1* 5/2006 Ishiyama et al. ..... 430/108.4
2008/0153027 A1* 6/2008 Veregin et al. ..... 430/113
2009/0035686 A1* 2/2009 Sacripante ..... 430/110.2
2009/0081573 A1* 3/2009 Iwazaki et al. ..... 430/108.7
2009/0305159 A1* 12/2009 Zhou et al. ..... 430/110.2
2010/0055595 A1* 3/2010 Shirai et al. ..... 430/109.4

FOREIGN PATENT DOCUMENTS

JP 2009-75342 A 4/2009
JP 2009-139588 A 6/2009

* cited by examiner

*Primary Examiner* — Jonathan Jelsma
(74) *Attorney, Agent, or Firm* — Birch, Stewart, Kolasch & Birch, LLP

(57) ABSTRACT

The present invention relates to a resin binder for toners which includes core/shell particles each including a core portion containing a crystalline polyester obtained by polycondensing an alcohol component containing an aliphatic diol having 2-12 carbon atoms and a carboxylic acid component containing an aliphatic dicarboxylic acid compound having 8-12 carbon atoms in an amount of 70-100 mol %, and a non-crystalline resin (A) obtained by polycondensing an alcohol component and a carboxylic acid component containing at least one succinic acid compound selected from the group consisting of an alkyl ($C_9$-$C_{18}$) succinic acid and an alkenyl ($C_9$-$C_{18}$) succinic acid in an amount of 3-60 mol %; and a shell portion containing a non-crystalline resin (B) obtained by polycondensing a carboxylic acid component and an alcohol component containing an aliphatic dialcohol having 2-5 carbon atoms in an amount of 80 mol % or more.

6 Claims, No Drawings

RESIN BINDERS FOR TONERS

FIELD OF THE INVENTION

The present invention relates to a resin binder for toners, a toner for electrophotography containing the resin binder, and a process for producing the toner.

BACKGROUND OF THE INVENTION

Crystalline polyesters have been recently noticed as a resin binder suitable for improving a low-temperature fusing property of toners because they have a high compatibility with non-crystalline polyesters and are readily dispersed therein, and exhibit a clear melting point owing to their crystalline moieties, unlike other crystalline resins such as polyethylene.

JP-A-2009-139588 ("JP-A" means unexamined published Japanese patent publication) discloses a toner for developing an electrostatic image which contains core/shell type toner particles each composed of a core layer containing at least a crystalline resin, a first resin binder, a releasing agent and a colorant and a shell layer containing a second resin binder, in which the crystalline resin has an endothermic peak temperature of from 25 to 50° C., a total content of the crystalline resin in the toner particles is from 3 to 15% by weight, and the toner particles have an acid value of 20 mg KOH/g or less, for the purpose of providing a toner for developing an electrostatic image which exhibits an excellent low-temperature fusing property and a good charging property even under high-humidity environmental conditions.

JP-A-2009-075342 discloses a toner for developing an electrostatic image which contains at least a crystalline polyester resin and a colorant, and has a dielectric loss factor $\in''$ of 0.1 or less as measured under the conditions of 0.1 Hz and 500 V at 30° C. and 90% RH, for the purpose of providing a toner for developing an electrostatic image which is capable of maintaining a low-temperature fusing property even under high-temperature and high-humidity conditions, forming a high-density image and suppressing occurrence of fogging.

The conventional core/shell toner particles containing a crystalline polyester obtained by polycondensing an alcohol component containing an aliphatic diol having 2 to 12 carbon atoms and a carboxylic acid component containing an aliphatic dicarboxylic acid compound having 8 to 12 carbon atoms in an amount of from 70 to 100 mol % are excellent in low-temperature fusing property, but have problems such as contamination of a carrier used therewith and a low charging rate.

JP-A-2009-139588 and JP-A-2009-075342 both disclose the core/shell toner particles containing the crystalline polyester, but fail to specify the above problems and provide a means for solving the problems.

SUMMARY OF THE INVENTION

The present invention relates to a resin binder for toners which is excellent in anti-staining property for carriers and charging rate while maintaining an excellent low-temperature fusing property, as well as a toner for electrophotography containing the resin binder.

Thus, the present invention relates to the following aspects [1] to [3].

[1] A resin binder for toners, including core/shell particles each including a core portion containing a crystalline polyester obtained by polycondensing an alcohol component containing an aliphatic diol having 2 to 12 carbon atoms and a carboxylic acid component containing an aliphatic dicarboxylic acid compound having 8 to 12 carbon atoms in an amount of from 70 to 100 mol %, and a non-crystalline resin (A) obtained by polycondensing an alcohol component and a carboxylic acid component containing at least one succinic acid compound selected from the group consisting of an alkyl ($C_9$ to $C_{18}$) succinic acid and an alkenyl ($C_9$ to $C_{18}$) succinic acid in an amount of from 3 to 60 mol %; and a shell portion containing a non-crystalline resin (B) obtained by polycondensing a carboxylic acid component and an alcohol component containing an aliphatic dialcohol having 2 to 5 carbon atoms in an amount of 80 mol % or more.

[2] A toner for electrophotography including the resin binder for toners as described in the above aspect [1].

[3] A process for producing a toner, including the following steps 1 to 4:

Step 1: mixing an aqueous dispersion containing a crystalline polyester obtained by polycondensing an alcohol component containing an aliphatic diol having 2 to 12 carbon atoms and a carboxylic acid component containing an aliphatic dicarboxylic acid compound having 8 to 12 carbon atoms in an amount of from 70 to 100 mol %, with an aqueous dispersion containing a non-crystalline resin (A) obtained by polycondensing an alcohol component and a carboxylic acid component containing at least one succinic acid compound selected from the group consisting of an alkyl ($C_9$ to $C_{18}$) succinic acid and an alkenyl ($C_9$ to $C_{18}$) succinic acid, and then aggregating the crystalline polyester and the non-crystalline resin (A) to prepare an aqueous solution of resin particles A;

Step 2: preparing an aqueous dispersion containing a non-crystalline resin (B) obtained by polycondensing a carboxylic acid component and an alcohol component containing an aliphatic dialcohol having 2 to 5 carbon atoms in an amount of 80 mol % or more;

Step 3: mixing the aqueous dispersion of the resin particles A prepared in the step 1 with the aqueous dispersion of the non-crystalline resin (B) prepared in the step 2 to aggregate the resin particles A and the non-crystalline resin (B), thereby preparing an aqueous dispersion of resin particles B; and Step 4: coalescing the resin particles B obtained in the step 3 to obtain coalesced particles thereof.

DETAILED DESCRIPTION OF THE INVENTION

The present inventors have found that a crystalline polyester obtained by polycondensing an alcohol component containing an aliphatic diol having 2 to 12 carbon atoms and a carboxylic acid component containing an aliphatic dicarboxylic acid compound having 8 to 12 carbon atoms in an amount of from 70 to 100 mol %, i.e., such a crystalline polyester produced by using the relatively long-chain aliphatic dicarboxylic acid compound, is excellent in low-temperature fusing property, but has such a problem that the resulting toner tends to be deteriorated in anti-staining property for carriers and charging rate, and have made extensive and intense researches on the problem. As a result, it has been found that the problem can be solved by incorporating the above crystalline polyester in a core portion of core/shell particles which each have the core portion composed of a non-crystalline resin (A) obtained by using at least one succinic acid compound selected from the group consisting of alkyl ($C_9$ to $C_{18}$) succinic acids and alkenyl ($C_9$ to $C_{18}$) succinic acids as an acid component of the resin and a shell portion composed of a non-crystalline resin (B) obtained by using an aliphatic dialcohol having 2 to 5 carbon atoms as an alcohol component of the resin.

The reason therefor is considered to be that the crystalline polyester incorporated in the core portion has a high compatibility with the non-crystalline resin contained in the core portion and therefore can be finely dispersed in the non-crystalline resin in the core portion, and further exhibits a poor compatibility with the non-crystalline resin contained in the shell portion and therefore can be prevented from migrating into the shell portion so that exposure of the crystalline polyester onto a surface of the respective toner particles can be effectively inhibited.

[Resin Binder]

The resin binder for toners according to the present invention includes core/shell particles which are each composed of a core portion containing a crystalline polyester and a non-crystalline resin (A), and a shell portion containing a non-crystalline resin (B).

(Crystalline Polyester)

The crystalline polyester as used in the present invention means a resin having a ratio of a softening point to an endothermic maximum peak temperature (softening point (° C.)/endothermic maximum peak temperature (° C.)) of from 0.6 to 1.3, preferably from 0.9 to 1.2, and more preferably more than 1 and not more than 1.2 as measured by the below-mentioned method.

Also, the non-crystalline resin as used herein means a resin having a ratio of a softening point to an endothermic maximum peak temperature (softening point (° C.)/endothermic maximum peak temperature (° C.)) of more than 1.3, or less than 0.6, preferably more than 1.3 and not more than 4, and more preferably from 1.5 to 3.

The crystalline polyester contained in the core portion of the resin binder according to the present invention is produced by polycondensing an alcohol component containing an aliphatic diol having 2 to 12 carbon atoms and a carboxylic acid component containing an aliphatic dicarboxylic acid compound having 8 to 12 carbon atoms in an amount of from 70 to 100 mol %.

<Alcohol Component>

The alcohol component as a raw monomer of the crystalline polyester contains an aliphatic diol having 2 to 12 carbon atoms from the viewpoint of enhancing a crystallinity of the polyester.

Examples of the aliphatic diol having 2 to 12 carbon atoms include ethylene glycol, 1,2-propylene glycol, 1,3-propylene glycol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, neopentyl glycol and 1,4-butenediol. Among these aliphatic diols, from the viewpoints of a good low-temperature fusing property, a good anti-staining property for carriers and a high charging rate of the resulting toner, preferred are aliphatic diols having 4 to 9 carbon atoms, and more preferred are aliphatic diols having 4 to 6 carbon atoms. Also, from the viewpoint of a high crystallinity, preferred are α,ω-linear alkanediols, and from the viewpoints of a good low-temperature fusing property, a good anti-staining property for carriers and a high charging rate of the resulting toner, more preferred is 1,6-hexanediol.

The content of the aliphatic diol having 2 to 12, preferably 4 to 9, more preferably 4 to 6 carbon atoms in the alcohol component is preferably 70 mol % or larger, more preferably from 80 to 100 mol % and still more preferably from 90 to 100 mol % from the viewpoints of a good low-temperature fusing property, a good anti-staining property for carriers and a high charging rate of the resulting toner as well as from the viewpoint of further enhancing a crystallinity of the crystalline polyester. The content of the α,ω-linear alkanediol having 2 to 12, preferably 4 to 9, more preferably 4 to 6 carbon atoms as aliphatic diol in the alcohol component is preferably 70 mol % or larger, more preferably from 70 to 100 mol % and still more preferably from 90 to 100 mol %. The α,ω-linear alkanediol is preferably one kind of alcohol from the viewpoint of enhancing a crystallinity of the crystalline polyester.

Examples of polyhydric alcohols other than the aliphatic diol having 2 to 12 carbon atoms which may be contained in the alcohol component include aromatic diols such as an alkyleneoxide adduct of bisphenol A represented by the following formula (I):

(I)

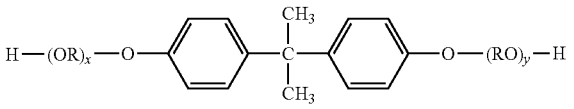

wherein R is an alkylene group having 2 or 3 carbon atoms; and x and y are respectively a positive number with the proviso that a sum of x and y is from 1 to 16 and preferably from 1.5 to 5, including a polyoxypropylene adduct of 2,2-bis(4-hydroxyphenyl)propane and a polyoxyethylene adduct of 2,2-bis(4-hydroxyphenyl)propane; and trivalent or higher-valent alcohols such as glycerol, pentaerythritol and trimethylol propane.

<Carboxylic Acid Component>

The carboxylic acid component as a raw monomer of the crystalline polyester contains an aliphatic dicarboxylic acid compound having 8 to 12 carbon atoms from the viewpoints of a low-temperature fusing property, an anti-staining property for carriers and a charging rate of the resulting toner.

In the present invention, carboxylic acids as well as derivatives of the carboxylic acids such as anhydrides and alkyl ($C_1$ to $C_3$) esters thereof are generally referred to as the "carboxylic acid compound". Meanwhile, the number of carbon atoms contained in the alkyl group of the alkyl esters is not included in the number of carbon atoms in the carboxylic acid compound.

Examples of the aliphatic dicarboxylic acid compound having 8 to 12 carbon atoms include suberic acid, azelaic acid, sebacic acid and 1,10-decanedicarboxylic acid. Among these acids, from the viewpoints of a low-temperature fusing property, an anti-staining property for carriers and a charging rate of the resulting toner, preferred are aliphatic dicarboxylic acid compounds having 10 to 12 carbon atoms, and more preferred is sebacic acid.

The content of the aliphatic dicarboxylic acid compound having 8 to 12 carbon atoms in the carboxylic acid component is from 70 to 100 mol %, preferably from 90 to 100 mol %, and more preferably substantially 100 mol %. When the content of the aliphatic dicarboxylic acid compound having 8 to 12 carbon atoms in the carboxylic acid component is less than 70 mol %, the resulting toner tends to be deteriorated in low-temperature fusing property.

In the present invention, the carboxylic acid component other than the aliphatic dicarboxylic acid compound having 8 to 12 carbon atoms may be used in combination therewith. Examples of the other carboxylic acid component include aromatic dicarboxylic acid compounds, aliphatic dicarboxylic acid compounds having 2 to 7 carbon atoms and trivalent or higher-valent aromatic polycarboxylic acid compounds, although not particularly limited thereto.

The aromatic dicarboxylic acid compound used in the present invention also includes aromatic dicarboxylic acid derivatives capable of forming the same constitutional unit as that derived from the aromatic dicarboxylic acid by condensation reaction thereof. Specific examples of the aromatic dicarboxylic acid compound include aromatic dicarboxylic acids such as phthalic acid, isophthalic acid and terephthalic acid, and anhydrides and alkyl ($C_1$ to $C_3$) esters of these acids. Examples of the alkyl group of the alkyl esters include methyl, ethyl, propyl and isopropyl.

Examples of the aliphatic dicarboxylic acid compounds having 2 to 7 carbon atoms include oxalic acid, malonic acid, maleic acid, fumaric acid, citraconic acid, itaconic acid, glutaconic acid, succinic acid and adipic acid; and anhydrides and alkyl ($C_1$ to $C_3$) esters of these acids.

Examples of the trivalent or higher-valent polycarboxylic acid compounds include aromatic carboxylic acids such as 1,2,4-benzenetricarboxylic acid (trimellitic acid), 2,5,7-naphthalenetricarobxylic acid and pyromellitic acid; and derivatives of these acids such as anhydrides and alkyl ($C_1$ to $C_3$) esters of these acids.

<Molar Ratio Between Alcohol Component and Carboxylic Acid Component>

The molar ratio of the carboxylic acid component to the alcohol component (carboxylic acid component/alcohol component) is preferably from 1.01 to 1.20, more preferably from 1.03 to 1.15 and still more preferably from 1.03 to 1.10 in order to enhance a low-temperature fusing property and a pressure storage property of the resulting toner.

<Composite Resin>

The crystalline polyester may also be used in the form of a composite resin prepared by further adding (i) a raw monomer of a styrene-based resin and (ii) a double reactive monomer capable of reacting with both of the raw monomer of the styrene-based resin and the alcohol component to the reaction system to subject these monomers together with the raw monomers of the polyester to not only the polycondensation reaction but also addition polymerization reaction.

As the raw monomer of the styrene-based resin component, there may be used styrene and a styrene compound such as α-methyl styrene and vinyl toluene (styrene and the styrene compound are hereinafter collectively referred to as a "styrene compound").

Examples of the raw monomer of the styrene-based resin component other than the above styrene compound include (meth)acrylic acid alkyl esters; ethylenically unsaturated monoolefins such as ethylene and propylene; diolefins such as butadiene; halovinyl compounds such as vinyl chloride; vinyl esters such as vinyl acetate and vinyl propionate; amino group-containing unsaturated monomers such as dimethylaminoethyl (meth)acrylate; vinyl ethers such as vinyl methyl ether; vinylidene halides such as vinylidene chloride; and N-vinyl compounds such as N-vinyl pyrrolidone.

The above raw monomers of the styrene-based resin component may be used in combination of any two or more thereof. Meanwhile, the term "(meth)acrylic acid" as used herein means acrylic acid and/or methacrylic acid.

Examples of the double reactive monomer capable of reacting with both of the raw monomer of the styrene-based resin and the alcohol component include compounds containing at least one functional group selected from the group consisting of a hydroxyl group, a carboxyl group, an epoxy group, a primary amino group and a secondary amino group in a molecule thereof. Among these compounds, preferred are compounds containing a hydroxyl group and/or a carboxyl group, and more preferred are compounds having a carboxyl group and an ethylenically unsaturated bond. By using such a double reactive monomer, it is possible to further enhance a dispersibility of the resin as a dispersed phase.

The double reactive monomer is preferably at least one compound selected from the group consisting of acrylic acid, methacrylic acid, fumaric acid, maleic acid and maleic anhydride. Among these monomers, from the viewpoint of a high reaction efficiency of the polycondensation reaction and addition polymerization reaction, preferred are acrylic acid, methacrylic acid and fumaric acid.

The amount of the double reactive monomer used in the above reactions is preferably from 2 to 25 mot, more preferably from 3 to 20 mol, still more preferably from 5 to 18 mol and further still more preferably from 8 to 15 mol per 100 mol of the alcohol component, and is preferably from 2 to 25 mol, more preferably from 3 to 20 mol, still more preferably from 5 to 18 mol and further still more preferably from 6 to 13 mol per 100 mol of the raw monomer of the styrene-based resin component, from the viewpoints of a dispersibility of the styrene-based resin component as well as a low-temperature fusing property, an anti-staining property for carriers and a charging rate of the resulting toner.

<Process for Producing Crystalline Polyester>

The crystalline polyester contained in the core portion of the resin binder according to the present invention may be obtained by polycondensing the above alcohol component and the above carboxylic acid component. The crystalline polyester is preferably produced by the process including the following steps (a) to (c).

Step (a): subjecting the alcohol component and the carboxylic acid component to polycondensation reaction;

Step (b): cooling the polyester obtained in the step (a) to a temperature of 40° C. or lower; and Step (c): heat-treating the polyester cooled in the step (b) to a temperature higher than 40° C. in the range of from an "endothermic maximum peak temperature (° C.) of the polyester− (minus) 40° C." to an "endothermic maximum peak temperature (° C.) of the polyester− (minus) 5° C.".

Meanwhile, in the present specification, the temperature referred to as merely the "endothermic maximum peak temperature" represents the value measured by the method described in Examples below.

[Step (a): Polycondensation Reaction]

In the step (a), the alcohol component and the carboxylic acid component are subjected to polycondensation reaction. The polycondensation reaction is preferably carried out in the presence of an esterification catalyst. From the viewpoint of obtaining a crystalline polyester having a high storage elastic modulus, the polycondensation reaction is preferably carried out in the presence of both the esterification catalyst and a pyrogallol compound.

Examples of the esterification catalyst suitably used in the polycondensation reaction include titanium compounds and tin (II) compounds containing no Sn—C bond. These titanium compounds and tin compounds as the esterification catalyst may be respectively used alone or in combination of both thereof.

The titanium compound is preferably a titanium compound having a Ti—O bond and more preferably a titanium compound containing an alkoxy group, an alkenyloxy group or an acyloxy group having 1 to 28 carbon atoms in total.

Specific examples of the titanium compound include titanium diisopropylate bis(triethanol aminate) [$Ti(C_6H_{14}O_3N)_2(C_3H_7O)_2$], titanium diisopropylate bis(diethanol aminate) [$Ti(C_4H_{10}O_2N)_2(C_3H_7O)_2$], titanium dipentylate bis(triethanol aminate) [$Ti(C_6H_{14}O_3N)_2(C_5H_{11}O)_2$], titanium diethylate bis(triethanol aminate) [$Ti(C_6H_{14}O_3N)_2(C_2H_5O)_2$], titanium dihydroxyoctylate bis(triethanol aminate) [$Ti(C_6H_{14}O_3N)_2(OHC_9H_{16}O)_2$], titanium distearate bis(triethanol aminate) [$Ti(C_6H_{14}O_3N)_2(C_{18}H_{37}O)_2$], titanium triisopropylate triethanol aminate [$Ti(C_6H_{14}O_3N)_1(C_3H_7O)_3$] and titanium monopropylate tris(triethanol aminate) [$Ti(C_6H_{14}O_3N)_3(C_3H_7O)_1$]. Among these titanium compounds, preferred are titanium diisopropylate bis(triethanol aminate), titanium diisopropylate bis(diethanol aminate) and titanium dipentylate bis(triethanol aminate). These titanium compounds are also available, for example, as commercial products marketed from Matsumoto Trading Co., Ltd.

Specific examples of the other suitable titanium compounds include tetra-n-butyl titanate [$Ti(C_4H_9O)_4$], tetrapropyl titanate [$Ti(C_3H_7O)_4$], tetrastearyl titanate [$Ti(C_{18}H_{37}O)_4$], tetramyristyl titanate [$Ti(C_{14}H_{29}O)_4$], tetraoctyl titanate [$Ti(C_8H_{17}O)_4$], dioctyldihydroxyoctyl titanate [$Ti(C_8H_{17}O)_2(OHC_8H_{16}O)_2$] and dimyristyl dioctyl titanate [$Ti(C_{14}H_{29}O)_2(C_8H_{17}O)_2$]. Among these other suitable titanium compounds, preferred are tetrastearyl titanate, tetramyristyl titanate, tetraoctyl titanate and dioctyldihydroxyoctyl titanate. These titanium compounds may be produced, for example, by reacting a titanium halide with a corresponding alcohol, and are also available as commercial products marketed from Nisso Co., Ltd.

Examples of the preferred tin (II) compound containing no Sn—C bond include tin (II) compounds having a Sn—O bond and tin (II) compounds having a Sn—X bond wherein X represents a halogen atom. Among these tin compounds, preferred are tin (II) compounds having a Sn—O bond.

Examples of the tin (H) compound having an Sn—O bond include tin (II) carboxylates containing a carboxyl group having 2 to 28 carbon atoms such as tin (II) oxalate, tin (II) diacetate, tin (II) dioctanoate, tin (II) dilaurate, tin (II) distearate and tin (II) dioleate; dialkoxy tin (II) containing an alkoxy group having 2 to 28 carbon atoms such as dioctyloxy tin (II), dilauryloxy tin (II), distearoxy tin (II) and dioleyloxy tin (II); tin (II) oxide; and tin (II) sulfate.

Examples of the tin (II) compound having a Sn—X bond wherein X represents a halogen atom include tin (II) halides such as tin (II) chloride and tin (II) bromide. Among these tin (II) compounds, in view of a good charging raise-up effect and a good catalyst performance, preferred are fatty acid tin (II) salts represented by the formula: $(R^1COO)_2Sn$ (wherein $R^1$ is an alkyl or alkenyl group having 5 to 19 carbon atoms), dialkoxy tin (II) compounds represented by the formula: $(R^2O)_2Sn$ (wherein $R^2$ is an alkyl or alkenyl group having 6 to 20 carbon atoms), and tin (II) oxide represented by the formula: SnO, more preferred are fatty acid tin (II) salts represented by the formula: $(R^1COO)_2Sn$ and tin (II) oxide, and still more preferred are tin (II) dioctanoate, tin (II) distearate and tin (II) oxide.

The above titanium compounds and the tin (II) compounds may be respectively used alone or in combination of any two or more thereof.

The amount of the esterification catalyst being present in the reaction system is preferably from 0.01 to 1 part by weight and more preferably from 0.1 to 0.6 parts by weight on the basis of 100 parts by weight of a total amount of the alcohol component and the carboxylic acid component.

Also, when using the raw monomer of the styrene-based resin component in the step (a), a known organic peroxide such as benzoyl peroxide, tert-butyl peroxybenzoate, diisopropyl peroxide, dicumyl peroxide, tart-butyl peroxydiisopropyl carbonate, 1,3-bis(tert-butyl peroxyisopropyl)benzene and 2,2-di-tert-butyl peroxybutane may be used as a polymerization initiator in combination therewith.

The pyrogallol compound is a compound containing a benzene ring in which three hydrogen atoms adjacent to each other are respectively substituted with a hydroxyl group. Examples of the pyrogallol compound include pyrogallol, gallic acid, gallic acid esters, benzophenone derivatives such as 2,3,4-trihydroxybenzophenone and 2,2',3,4-tetrahydroxybenzophenone, and catechin derivatives such as epigallocatechin and epigallocatechin gallate.

The amount of the pyrogallol compound being present in the polycondensation reaction system is preferably from 0.001 to 1 parts by weight, more preferably from 0.005 to 0.4 parts by weight and still more preferably from 0.01 to 0.2 parts by weight on the basis of 100 parts by weight of a total amount of the alcohol component and the carboxylic acid component which are subjected to the polycondensation reaction. The "amount of the pyrogallol compound being present" as used herein means a total amount of the pyrogallol compound added which is subjected to the polycondensation reaction.

The weight ratio of the pyrogallol compound to the esterification catalyst (pyrogallol compound/esterification catalyst) is preferably from 0.01 to 0.5, more preferably from 0.03 to 0.3 and still more preferably from 0.05 to 0.2 from the viewpoint of a good durability of the resulting resin.

In addition, the catalyst is preferably added to the reaction system when a reaction rate of the polycondensation reaction (polycondensation reaction rate as calculated from an amount of a reaction water discharged from the reaction system assuming that the reaction rate upon discharge of a theoretical amount of the reaction water is 100%; hereinafter defined in the same way) reaches 70% or more from the viewpoints of a low-temperature fusing property, an anti-staining property for carriers and a charging property of the resulting toner. The catalyst tends to be deactivated by the reaction water. The catalyst continuously used from an early stage of the reaction and finally deactivated tends to have adverse influences on an activity of a catalyst added at a later stage of the reaction, or tends to deteriorate a crystallinity of the obtained crystalline polyester. Therefore, the amount of the catalyst added at the early stage of the reaction is preferably restricted to a small level from the above viewpoints.

The amount of the catalyst added when the reaction rate of the polycondensation reaction reaches 70% or more and preferably from 70 to 90% is preferably 50% by weight or more, more preferably 70% by weight or more, and still more preferably 80% by weight or more on the basis of a whole amount of the catalyst added to the reaction system from the above viewpoints.

In addition, the polycondensation reaction is preferably carried out at a reaction rate of the polycondensation reaction of 90% or more under a reduced pressure of 12 kPa or less for a pressure-reduced period of 1 hour or longer, more preferably from 1 to 10 hours and still more preferably from 1 to 5 hours, from the viewpoints of a low-temperature fusing property, an anti-staining property for carriers and a charging property of the resulting toner.

The polycondensation reaction between the alcohol component and the carboxylic acid component may be carried out, for example, in the presence of the esterification catalyst such as a tin compound and a titanium compound, and a polymerization inhibitor in an inert gas atmosphere. The temperature used in the polycondensation reaction is preferably from 120 to 250° C., and the final temperature to be reached is preferably from 180 to 250° C. and more preferably from 190 to 230° C.

In addition, the polycondensation reaction is suitably carried out in a temperature range of from 120 to 160° C. and preferably from 130 to 150° C. for a period of preferably from 3 to 12 hours, more preferably from 3 to 10 hours and still more preferably from 3 to 8 hours during the temperature rise step therein. When conducting the polycondensation reaction under the above conditions, the monomer components are reacted to a sufficient extent as compared to the case where they are rapidly reacted at a high temperature, which results in improvement in a low-temperature fusing property, an anti-staining property for carriers and a charging property of the resulting toner.

The terminal point of the polycondensation reaction is the time at which the crystalline polyester is withdrawn from a reaction vessel in the case where the reaction is terminated in the reaction vessel using no stirrer, or the time at which the stirring procedure is substantially stopped in the case where the reaction is terminated in the reaction vessel using a stirrer. Meanwhile, the terminal point of the polycondensation reaction may vary depending upon properties of the resin to be obtained, and is usually at the time at which the reaction rate of the polycondensation reaction reaches 90% or more. The stirring rate during the polycondensation reaction is preferably from about 50 to about 1,000 rpm and more preferably from about 100 to about 500 rpm.

[Step (b): Cooling]

In the step (b), the polyester obtained in the above step (a) is cooled to a temperature of 40° C. or lower. From the viewpoints of a low-temperature fusing property, an anti-staining property for carriers and a charging rate of the resulting toner, the cooling procedure is preferably carried out until reaching a temperature of 35° C. or lower, and more preferably until reaching a temperature of 30° C. or lower. With this cooling procedure, it is possible to deposit crystals to a sufficient extent. When insufficiently cooled, deposition of the crystals tends to be insufficient, so that the resulting toner tends to be deteriorated in a low-temperature fusing property, an anti-staining property for carriers and a charging rate. The cooling step may be carried out by a cooling method such as air cooling and water cooling. Also, the cooling step may be practically performed using a cooling apparatus such as a steam belt cooler (available from Nippon Belting Co., Ltd., Sandvik AB, and the like) and a drum cooler (available from Mitsubishi Chemical Engineering Corporation, Nippon Coke & Engineering Co., Ltd., and the like).

In order to sufficiently deposit crystals, the cooling time needed until the temperature upon terminating the polycondensation reaction for production of the crystalline polyester is dropped to 40° C. is preferably from 1 to 24 hours. The cooling time is more preferably from 3 to 18 hours and still more preferably from 5 to 12 hours from the viewpoints of a low-temperature fusing property, an anti-staining property for carriers and a charging rate of the resulting toner. When the cooling time needed until being dropped to 40° C. lies within the above-specified range, the crystallization proceeds to a sufficient extent, thereby further enhancing a low-temperature fusing property, an anti-staining property for carriers and a charging rate of the resulting toner. Meanwhile, the cooling rate is preferably from 5 to 100° C./h, and more preferably from 10 to 85° C./h. The cooling procedure is preferably conducted at a constant cooling rate. During the cooling procedure, the change in cooling rate is preferably controlled within ±20° C./h (more preferably within ±10° C./h, still more preferably within ±5° C./h and further still more preferably within ±3° C./h).

From the viewpoints of a low-temperature fusing property, an anti-staining property for carriers and a charging rate of the resulting toner, the time interval between completion of the step (b) and initiation of the below-mentioned heat-treating step (c) (hereinafter referred to as a "given transition time from the step (b) to the step (c)") is preferably 1 day or longer, more preferably from 1 to 30 clays and still more preferably from 1 to 15 days. Thus, the polyester obtained in the step (b) is allowed to stand at a temperature not higher than the temperature of the polyester after being cooled (40° C. or lower), preferably from 0 to 40° C., more preferably from 5 to 35° C. and still more preferably from 5 to 30° C. Since the crystallization proceeds even after cooling the crystalline polyester in the step (b), from the above viewpoints, the crystalline polyester is preferably subjected to the heat treatment in the step (c) after the elapse of the given transition time from the step (b) to the step (c) in order to allow the crystallization of the polyester to sufficiently proceed.

[Step (c): Heat Treatment]

In the step (c), the polyester cooled in the step (b) is heat-treated at a temperature higher than 40° C. in the range of from an "endothermic maximum peak temperature (° C.) of the polyester− (minus) 40° C." to an "endothermic maximum peak temperature (° C.) of the polyester− (minus) 5° C.". The heat treatment is carried out substantially in the presence of the crystalline polyester solely. The endothermic maximum peak temperature of the polyester as used herein means the temperature value obtained by cooling the crystalline polyester cooled in the step (b) to room temperature (20° C.) and then measuring endothermic peaks of the crystalline polyester using a differential scanning calorimeter (DSC) under the conditions described in Examples below. The endothermic maximum peak temperature (° C.) of the crystalline polyester is measured upon the given transition time from the step (b) to the step (c), and essentially remains unchanged even when the given transition time from the step (b) to the step (c) is varied.

The heat-treating temperature is preferably from the "endothermic maximum peak temperature (° C.) of the polyester− (minus) 35° C." to the "endothermic maximum peak temperature (° C.) of the polyester− (minus) 10° C.", more preferably from the "endothermic maximum peak temperature (° C.) of the polyester− (minus) 30° C." to the "endothermic maximum peak temperature (° C.) of the polyester− (minus) 10° C.", still more preferably from the "endothermic maximum peak temperature (° C.) of the polyester− (minus) 25° C." to the "endothermic maximum peak temperature (° C.) of the polyester− (minus) 10° C." and further still more preferably from the "endothermic maximum peak temperature (CC) of the polyester− (minus) 25° C." to the "endothermic maximum peak temperature (° C.) of the polyester− (minus) 14° C." from the viewpoints of obtaining uniform crystals, reducing a particle size of the polyester upon formation of an aqueous dispersion thereof and decreasing a coefficient of variation of particle size distribution (CV value) of the crystalline polyester particles, as well as from the viewpoints of a low-temperature fusing property, an anti-staining property for carriers and a charging rate of the resulting toner.

The heat-treating time is preferably from 0.5 to 48 hours, more preferably from 1 to 24 hours, still more preferably from 3 to 18 hours and further still more preferably from 5 to 15 hours from the viewpoints of a low-temperature fusing property, an anti-staining property for carriers and a charging rate of the resulting toner. When the heat-treating time lies within the above-specified range, it is considered that uniform crystals of the polyester are obtained.

The heat treatment in the step (c) may be carried out using an oven and the like. For example, when using the oven, the polyester obtained in the step (b) is placed as such in the oven and held within the above temperature range to thereby conduct the heat treatment in a simplified manner.

<Properties of Crystalline Polyester>

The thus obtained crystalline polyester is useful as a crystalline polyester for toners. The properties of the crystalline polyester used in the present invention are as follows.

The number-average molecular weight of the crystalline polyester used in the present invention is not particularly limited, and is generally preferably 1,000 or more, and more preferably 1,500 or more. However, in view of a high productivity of the crystalline polyester, the number-average molecular weight thereof is preferably 6,000 or less, more preferably 5,000 or less and still more preferably 4,500 or less. From the above viewpoints, the number-average molecular weight of the crystalline polyester used in the present invention is preferably from 1,000 to 6,000, more preferably from 1,000 to 5,000 and still more preferably from 1,500 to 4,500.

Also, from the same viewpoints as those for the number-average molecular weight, the weight-average molecular weight of the crystalline polyester used in the present invention is preferably 3,000 or more, more preferably 5,000 or more, and still more preferably 8,000 or more, and is preferably 100,000 or less, more preferably 50,000 or less, still more preferably 30,000 or less and further still more preferably 20,000 or less. From the above viewpoints, the weight-average molecular weight of the crystalline polyester used in the present invention is preferably from 3,000 to 100,000, more preferably from 5,000 to 50,000, still more preferably from 5,000 to 30,000 and further still more preferably from 8,000 to 20,000.

Meanwhile, in the present invention, the number-average molecular weight and the weight-average molecular weight of the crystalline polyester respectively mean the value as measured with respect to a chloroform soluble component in the crystalline polyester.

When the crystalline polyester is used in the form of the composite resin, the number-average molecular weight of the styrene-based resin component in the crystalline polyester is preferably from 400 to 7,000, more preferably from 1,000 to 4,000, and still more preferably from 1,500 to 3,000 from the viewpoint of a good dispersibility of the styrene-based resin in the crystalline resin in the form of a composite resin. In the present invention, the number-average molecular weight of the styrene-based resin means the value as measured with respect to a tetrahydrofuran (THF) soluble component therein.

From the viewpoints of a low-temperature fusing property, an anti-staining property for carriers and a charging rate of the resulting toner, the crystalline polyester used in the present invention preferably has a softening point of from 60 to 160° C., more preferably from 60 to 120° C., still more preferably from 65 to 100° C. and further still more preferably from 65 to 90° C.

The melting point of the crystalline polyester used in the present invention is preferably from 60 to 130° C., more preferably from 65 to 110° C. and still more preferably from 65 to 90° C. from the viewpoints of a low-temperature fusing property, an anti-staining property for carriers and a charging rate of the resulting toner.

The acid value of the crystalline polyester used in the present invention is preferably from 1 to 40 mg KOH/g, more preferably from 2 to 35 mg KOH/g and still more preferably from 3 to 30 mg KOH/g from the viewpoint of a good dispersibility of the crystalline polyester in the aqueous dispersion.

The number-average molecular weight, softening point, melting point and acid value of the crystalline polyester may be readily adjusted by appropriately controlling a composition of the raw monomers, a polymerization initiator, a molecular weight, an amount of a catalyst used or the like, or selecting suitable reaction conditions.

(Non-Crystalline Resin (A))

The non-crystalline resin (A) contained in the core portion of the resin binder according to the present invention is obtained by polycondensing an alcohol component and a carboxylic acid component containing at least one succinic acid compound selected from the group consisting of an alkyl ($C_9$ to $C_{18}$) succinic acid and an alkenyl ($C_9$ to $C_{18}$) succinic acid (hereinafter occasionally referred to as merely a "succinic acid compound"). In the resin binder according to the present invention, since the core portion contains the non-crystalline resin (A), the crystalline polyester is finely dispersed in the core portion and therefore retained in the core portion. As a result, it is considered that the crystalline polyester is prevented from migrating into the shell portion and therefore from exposing onto a surface of the respective toner particles, thereby enhancing a low-temperature fusing property, an anti-staining property for carriers and a charging rate of the resulting toner.

<Carboxylic Acid Component>

The carboxylic acid component as the raw monomer of the non-crystalline resin (A) contains at least one succinic acid compound selected from the group consisting of an alkyl ($C_9$ to $C_{18}$) succinic acid and an alkenyl ($C_9$ to $C_{18}$) succinic acid from the viewpoints of allowing the crystalline polyester to be finely dispersed in the core portion and confined in the core/shell particles and enhancing an anti-staining property for carriers and a charging rate of the resulting toner. Meanwhile, the succinic acid compound may be in the form of an anhydride or a lower alkyl ($C_1$ to $C_3$) ester of the alkyl succinic acid and alkenyl succinic acid.

The number of carbon atoms contained in the alkyl group or alkenyl group of the alkyl succinic acid and alkenyl succinic acid is from 9 to 18, preferably from 9 to 14 and more preferably from 10 to 12 from the viewpoints of a low-temperature fusing property, an anti-staining property for carriers and a charging rate of the resulting toner. The alkyl group and alkenyl group may be either linear or branched. However, these groups preferably have a branched chain from the viewpoint of enhancing an anti-staining property for carriers and a charging rate of the resulting toner.

In addition, from the viewpoint of enhancing a low-temperature fusing property, an anti-staining property for carriers and a charging rate of the resulting toner, the succinic acid compound preferably includes two or more kinds of compounds selected from the group consisting of alkyl succinic acids containing a branched alkyl group having 9 to 18 carbon atoms and alkenyl succinic acids containing a branched alkenyl group having 9 to 18 carbon atoms. The "kinds" as used herein mean those owing to difference of the alkyl group or the alkenyl group. Thus, the alkyl succinic acids or the alkenyl succinic acids which are different in chain length, i.e., number of carbon atoms in the alkyl group or the alkenyl group, from each other, as well as structural isomers thereof are herein regarded and handled as different kinds of alkyl succinic acids or alkenyl succinic acids.

Therefore, as the succinic acid compound, preferred are those compounds composed of two or more kinds of alkyl succinic acids containing a branched alkyl group preferably having 9 to 18 carbon atoms and more preferably 9 to 14 carbon atoms; those compounds composed of two or more kinds of alkenyl succinic acids containing a branched alkenyl group preferably having 9 to 18 carbon atoms and more preferably 9 to 14 carbon atoms; or those compounds composed of one or more kinds of the alkyl succinic acids and one or more kinds of the alkenyl succinic acids. When using combination of the succinic acid compounds containing branched alkyl groups and/or alkenyl groups which are different in number of carbon atoms therein from each other, the resulting resin has a broad endothermic peak near a glass transition point thereof as measured by differential scanning calorimetry (DSC), so that the resin binder for toners using such a resin exhibits a very wide fusing range.

Specific examples of the branched alkyl and alkenyl groups having 9 to 18 carbon atoms include an isododecenyl group and an isodecyl group.

From the viewpoint of enhancing an anti-staining property for carriers, a charging rate and a low-temperature fusing property of the resulting toner, the alkyl succinic acid and alkenyl succinic acid are preferably produced by reacting an alkylene group-containing compound (alkylene compound) with at least one compound selected from the group consisting of maleic acid, fumaric acid and an anhydride thereof.

The alkylene compound preferably has 9 to 18 carbon atoms and more preferably 9 to 14 carbon atoms. Specific examples of the alkylene compound include those compounds derived from an alkylene such as ethylene, propylene, isobutylene and n-butylene, for example, a trimer or a tetramer of these alkylenes. As a suitable raw material used for synthesis of the alkylene compound, propylene having a low molecular weight is preferably used from the viewpoint of increasing the number of structural isomers. From the viewpoint of allowing the polycondensation-based resin obtained from the succinic acid compound to exhibit a very wide fusing range when used as the resin binder for toner, the alkylene compound preferably has 2 or more peaks corresponding to the alkylene compounds having 9 to 18 carbon atoms and preferably 9 to 14 carbon atoms as measured by gas chromatographic mass spectrometry under the below-mentioned conditions. The number of the peaks observed in the above analysis is more preferably 10 or more, still more preferably 20 or more, further still more preferably 30 or more, and is preferably 80 or less and more preferably 60 or less.

Examples of a catalyst suitably used for synthesis of the alkylene compound include liquid phosphoric acid, solid phosphoric acid, tungsten and a boron trifluoride complex. Meanwhile, from the viewpoint of readily controlling the number of the structural isomers to be formed, there is preferably used the method in which after completion of the random polymerization, the resulting product is conditioned by distillation.

On the other hand, among maleic acid, fumaric acid and an acid anhydride thereof, preferred is maleic anhydride from the viewpoint of a good reactivity.

The alkyl succinic acid and alkenyl succinic acid may be produced by an optional method, for example, by using an ene reaction in which the alkylene compound is mixed with at least one compound selected from the group consisting of maleic acid, fumaric acid and an anhydride of these acids, followed by heating the resulting mixture (refer to 2-A-48-23405, JP-A-48-23404, U.S. Pat. No. 3,374,285 and the like).

The content of the succinic acid compound in the carboxylic acid component is preferably from 3 to 60 mol %, more preferably from 5 to 45 mol % and still more preferably from 10 to 40 mol % from the viewpoints of a low-temperature fusing property, a storage property and a charging stability under high-temperature and high-humidity conditions of the resulting toner.

The carboxylic acid component may also contain, in addition to the succinic acid compound, a dicarboxylic acid compound or a trivalent or higher-valent polycarboxylic acid compound.

Examples of the dicarboxylic acid compound include aliphatic dicarboxylic acids such as oxalic acid, malonic acid, maleic acid, fumaric acid, citraconic acid, itaconic acid, glutaconic acid, succinic acid, adipic acid, sebacic acid and azelaic acid; aromatic dicarboxylic acids such as phthalic acid, isophthalic acid and terephthalic acid; alicyclic dicarboxylic acids such as cyclohexanedicarboxylic acid; and anhydrides and alkyl ($C_1$ to $C_3$) esters of these acids. In the present invention, the above acids and the above anhydrides and alkyl esters of these acids are generally referred to as the "carboxylic acid compound".

The carboxylic acid component of the non-crystalline resin (A) preferably contains an aromatic dicarboxylic acid compound from the viewpoint of a high charging rate of the resulting toner. The content of the aromatic dicarboxylic acid compound in the carboxylic acid component is preferably from 30 to 90 mol %, more preferably from 40 to 90 mol % and still more preferably from 50 to 85 mol % from the viewpoints of a low-temperature fusing property and a charging rate of the resulting toner.

Examples of the trivalent or higher-valent polycarboxylic acid compounds include aromatic carboxylic acids such as 1,2,4-benzenetricarboxylic acid (trimellitic acid), 2,5,7-naphthalenetricarobxylic acid and pyromellitic acid; and derivatives of these acids such as anhydrides and alkyl ($C_1$ to $C_3$) esters of these acids.

Examples of the other carboxylic acid compounds include rosin; and rosins modified with fumaric acid, maleic acid, acrylic acid, and the like.

In the present invention, the carboxylic acid component preferably contains the trivalent or higher-valent polycarboxylic acid compound, more preferably a trimellitic acid compound and still more preferably trimellitic anhydride from the viewpoints of increasing a molecular weight of the resulting resin and enhancing an anti-staining property for carriers and a storage property of the resulting toner. The content of the trivalent or higher-valent polycarboxylic acid compound in the carboxylic acid component is preferably from 0.1 to 30 mol %, more preferably from 1 to 25 mol % and still more preferably from 5 to 25 mol %.

<Alcohol Component>

The alcohol component as the raw monomer of the non-crystalline resin (A) is an aliphatic diol preferably having 2 to 5 carbon atoms and more preferably 3 to 4 carbon atoms from the viewpoints of improving an affinity between the non-crystalline resin (A) and the non-crystalline resin (B) and enhancing a low-temperature fusing property and a charging rate of the resulting toner. Even when the short-chain aliphatic alcohol having a low compatibility with the crystalline polyester is used as the alcohol component, it is considered that by using the above succinic acid compound as the carboxylic acid component, the crystalline polyester can be finely dispersed in the non-crystalline resin (A).

Examples of the aliphatic diol having 2 to 5 carbon atoms include ethylene glycol, 1,2-propanediol, 1,3-propanediol, 1,2-butanediol, 1,3-butanediol, 1,4-butanediol, 2,3-butanediol, 1,2-pentanediol, 1,3-pentanediol, 1,4-pentanediol, 1,5-pentanediol, neopentyl glycol, 2,3-pentanediol and 2,4-pentanedial. Among these aliphatic diols, from the above viewpoints, preferred is at least one aliphatic diol selected from the group consisting of ethylene glycol, 1,2-propanediol, 1,3-propanediol, 2,3-butanediol and neopentyl glycol, and more preferred are 1,2-propanediol and 2,3-butanediol.

The content of the aliphatic diol having 2 to 5 carbon atoms in the alcohol component is preferably from 80 to 100 mol %, more preferably from 90 to 100 mol % and still more preferably from 95 to 100 mol % from the viewpoints of a low-temperature fusing property and a charging rate of the resulting toner.

Examples of the other alcohols which may be contained in the alcohol component include an alkyleneoxide adduct of bisphenol A represented by the following formula (II) and an aliphatic diol. Among these alcohols, from the viewpoint of a storage property of the resulting toner, preferred is the alkyleneoxide adduct of bisphenol A.

(II)

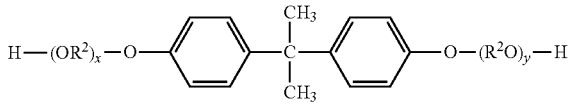

wherein $R^2O$ and $OR^2$ are respectively an oxyalkylene group; $R^2$ is an ethylene group and/or a propylene group; x and y each represent a molar number of addition of alkyleneoxides and are each a positive number with the proviso that an average value of a sum of x and y is preferably from 1 to 16, more preferably from 1 to 8 and still more preferably from 1.5 to 4.

Specific examples of the alkyleneoxide adduct of bisphenol A represented by the above formula (II) include a polyoxypropylene adduct of 2,2-bis(4-hydroxyphenyl)propane and a polyoxyethylene adduct of 2,2-bis(4-hydroxyphenyl) propane.

The content of the alkyleneoxide adduct of bisphenol A in the alcohol component is preferably from 0 to 20 mol %, more preferably from 0 to 10 mol % and still more preferably from 0 to 5 mol % from the viewpoint of a storage property of the resulting toner.

(Non-Crystalline Resin (B))

The non-crystalline resin (B) forming the shell portion of the resin binder according to the present invention is obtained by polycondensing a carboxylic acid component and an alcohol component containing an aliphatic dialcohol having 2 to 5 carbon atoms in an amount of 80 mol % or more.

The non-crystalline resin (B) in the shell portion of the resin binder has a low compatibility with the crystalline polyester. Therefore, it is considered that the non-crystalline resin (B) serves for enhancing an anti-staining property for carriers and a charging property of the resulting toner by confining the crystalline polyester within the core portion.

<Alcohol Component>

The alcohol component as the raw monomer of the non-crystalline resin (B) is preferably an aliphatic diol having 2 to 5 carbon atoms and more preferably 3 to 4 carbon atoms from the viewpoints of not only improving an affinity between the non-crystalline resin (A) and the non-crystalline resin (B) but also allowing the obtained resin to exhibit a low compatibility with the crystalline polyester and thereby confine the crystalline polyester within the core/shell particles.

The alcohol component as the raw monomer of the non-crystalline resin (B) is the same as those explained as to the alcohol component as the raw material of the non-crystalline resin (A), and the preferred examples of the alcohol component also include the same compounds as described above. Among these compounds, more preferred are 1,2-propanediol and 2,3-butanediol.

The content of the aliphatic diol having 2 to 5 carbon atoms in the alcohol component is preferably from 80 to 100 mol %, more preferably from 90 to 100 mol % and still more preferably from 95 to 100 mol % from the viewpoints of a low-temperature fusing property, an anti-staining property for carriers and a charging rate of the resulting toner.

<Carboxylic Acid Component>

The carboxylic acid component as the raw monomer of the non-crystalline resin (B) may contain the same dicarboxylic acid compound or trivalent or higher-valent polycarboxylic acid compound as that used in the core portion.

The carboxylic acid component of the non-crystalline resin (B) preferably contains an aromatic dicarboxylic acid compound from the viewpoint of a high charging rate of the resulting toner. The content of the aromatic dicarboxylic acid compound in the carboxylic acid component is preferably from 30 to 90 mol %, more preferably from 50 to 90 mol % and further preferably from 60 to 90 mol % from the viewpoints of a low-temperature fusing property and a charging rate of the resulting toner.

In addition, from the viewpoints of increasing a molecular weight of the resin and enhancing an anti-staining property for carriers and a storage property of the resulting toner, the carboxylic acid component of the non-crystalline resin (B) preferably contains a trivalent or higher-valent polycarboxylic acid compound, more preferably a trimellitic acid compound and still more preferably trimellitic anhydride. The content of the trivalent or higher-valent polycarboxylic acid compound in the carboxylic acid component is preferably from 0.1 to 30 mol %, more preferably from 1 to 25 mol % and still more preferably from 5 to 25 mol %.

However, from the viewpoints of lowering a compatibility with the crystalline polyester and confining the crystalline polyester within the core/shell particles, the carboxylic acid component as the raw monomer of the non-crystalline resin (B) preferably contains substantially no succinic acid compound which is at least one compound selected from the group consisting of an alkyl succinic acid and an alkenyl succinic acid. The term "contains substantially no succinic acid compound" as used herein means that the content of the succinic acid compound in the carboxylic acid component is 2 mol % or less, preferably 1 mol % or less, more preferably 0.5 mol % or less, still more preferably 0.1 mol % or less, and further still more preferably 0 mol %.

The carboxylic acid component as the raw monomer of the non-crystalline resin (B) is the same as the carboxylic acid component as the raw monomer of the non-crystalline resin (A) except that the former carboxylic acid component contains substantially no succinic acid compound which is at least one compound selected from the group consisting of an alkyl succinic acid and an alkenyl succinic acid.

<Properties of Non-Crystalline Resins (A) and (B)>

The number-average molecular weights of the non-crystalline resins (A) and (B) are each independently preferably from 1,000 to 6,000 and more preferably from 2,000 to 5,000. Also, the weight-average molecular weights of the non-crystalline resins (A) and (B) are each independently preferably 10,000 or more, more preferably 30,000 or more, and is preferably 1,000,000 or less. Meanwhile, the number-average molecular weight and the weight-average molecular weight of the respective non-crystalline resins mean the value measured with respect to a tetrahydrofuran soluble component therein.

The softening points of the non-crystalline resins (A) and (B) are each independently preferably from 70 to 180° C. and more preferably from 90 to 150° C. from the viewpoints of a low-temperature fusing property, an anti-staining property for carriers and a charging rate of the resulting toner. Meanwhile, the non-crystalline resins (A) and (B) used in the present invention may be each in the form of a mixed resin composed of a resin having a higher softening point (hereinafter referred to as a "higher-softening point resin") and a resin having a lower softening point (hereinafter referred to as a "lower-softening point resin"). By using the higher-softening point and lower softening point resins in the respective non-crystalline resins, the resulting toner becomes more excellent in view of a low-temperature fusing property thereof. When the higher-softening point resin is used in combination with the lower-softening point resin, one or both of the higher-softening point resin and the lower-softening point resin may be composed of two or more kinds of resins.

In general, in the ease of the core/shell particles, in order to confine the crystalline polyester within the core portion thereof, the softening point of the non-crystalline resin used in the shell portion may be usually higher than that used in the core portion. On the contrary, in the present invention, since the specific resins are respectively used in the core and shell portions, the crystalline polyester can be confined within the core portion even when the softening point of the non-crystalline resin (B) in the shell portion is lower than that of the non-crystalline resin (A) in the core portion. As a result, it is possible to enhance a low-temperature fusing property and a charging rate of the resulting toner.

From the above viewpoints, the softening point of the non-crystalline resin (B) in the shell portion is preferably lower than the softening point of the non-crystalline resin (A) in the core portion, and the former softening point is more preferably lower by 10° C. or more, still more preferably lower by 15° C. or more, and further still more preferably lower by 20° C. or more, than the latter softening point. The upper limit of the difference between the softening points of the non-crystalline resins (A) and (B) is preferably 50° C. or less.

Therefore, the softening point of the non-crystalline resin (A) in the core portion is preferably from 115 to 150° C. and more preferably from 115 to 140° C., whereas the softening point of the non-crystalline resin (B) in the shell portion is preferably not lower than 90° C. and lower than 115° C., and more preferably from 95 to 110° C.

From the viewpoints of a low-temperature fusing property, an anti-staining property for carriers and a charging rate of the resulting toner, the glass transition temperature (Tg) of the respective non-crystalline resins is preferably from 45 to 80° C. and more preferably from 55 to 75° C.

The acid value of the respective non-crystalline resins is preferably from 1 to 40 mg KOH/g, more preferably from 2 to 35 mg KOH/g and still more preferably from 3 to 30 mg KOH/g from the viewpoint of attaining a good dispersibility of the respective non-crystalline resins in the aqueous dispersion.

Meanwhile, the number-average molecular weight, softening point, Tg, and acid value of the respective non-crystalline resins may be readily controlled by suitably adjusting a composition of the raw monomers used, a polymerization initiator, a molecular weight, an amount of a catalyst used or the like, or selecting suitable reaction conditions.

<Modified Non-Crystalline Resins>

The non-crystalline resins (A) and (B) used in the present invention may also respectively include a modified non-crystalline resin.

Examples of the modified non-crystalline resins include urethane-modified polyesters obtained by modifying the resin with a urethane bond, epoxy-modified polyesters obtained by modifying the polyester with an epoxy bond, and hybrid resins containing two or more kinds of resins including a polyester component.

The non-crystalline resin used in the present invention may be constituted of either one or both of the above polyester resin and the modified non-crystalline resin thereof. More specifically, the non-crystalline resin may be the polyester resin solely and/or a hybrid resin composed of the polyester and the styrene-based resin.

(Resin Binder for Toners)

The resin binder for toners according to the present invention is composed of the core/shell particles.

The weight ratio of the crystalline polyester to the non-crystalline resin (A) [crystalline polyester/non-crystalline resin (A)] in the core portion is preferably from 5/95 to 40/60, more preferably from 6/94 to 30/70 and still more preferably from 7/93 to 25/75 from the viewpoints of a low-temperature fusing property, an anti-staining property for carriers and a charging rate of the resulting toner.

The weight ratio of the crystalline polyester to a sum of the non-crystalline resins (A) and (B) [crystalline polyester/non-crystalline resins [(A)+(B)]] in the core/shell particles is preferably from 5/95 to 40/60, more preferably from 6/94 to 30/70 and still more preferably from 7/93 to 25/75 from the viewpoints of a low-temperature fusing property, an anti-staining property for carriers and a charging rate of the resulting toner.

The weight ratio of the non-crystalline resin (A) to the non-crystalline resin (B) [non-crystalline resin (A)/non-crystalline resin (B)] is preferably from 50/50 to 95/5, more preferably from 60/40 to 95/5 and still more preferably from 70/30 to 90/10 from the viewpoints of a low-temperature fusing property, an anti-staining property for carriers and a charging rate of the resulting toner.

The acid value of the resin binder is preferably from 1 to 40 mg KOH/g, more preferably from 2 to 35 mg KOH/g and still more preferably from 3 to 30 mg KOH/g from the viewpoints of a good charging property and a good hydrolysis resistance of the resulting toner.

The softening point of the resin binder is preferably from 80 to 160° C., more preferably from 80 to 150° C. and still more preferably from 90 to 140° C. from the viewpoints of a low-temperature fusing property, an anti-staining property for carriers and a charging rate of the resulting toner. Also, the glass transition temperature of the toner is preferably from 45 to 80° C. and more preferably from 50 to 70° C. from the same viewpoints as described above.

The resin binder for toners according to the present invention is preferably obtained by the below-mentioned production process.

The toner for electrophotography according to the present invention which contains the above resin binder may also contain known resin binders for toners other than the above resin binder unless the effects of the present invention are adversely affected. Examples of the other known resin binders include those resins such as polyesters, styrene-based resins such as styrene-acrylic resins, epoxy resins, polycarbonates and polyurethanes.

In the toner for electrophotography according to the present invention, the content of the resin binder for toners according to the present invention is preferably 50% by weight or more, more preferably 70% by weight or more, still more preferably 80% by weight or more, further still more preferably 90% by weight or more, and especially preferably substantially 100% by weight on the basis of a total weight of the whole resin binders contained therein.

[Process for Producing Toner]

The toner according to the present invention can be produced by the process including the following steps 1 to 4:

Step 1: mixing an aqueous dispersion containing a crystalline polyester obtained by polycondensing an alcohol component containing an aliphatic diol having 2 to 12 carbon atoms and a carboxylic acid component containing an aliphatic dicarboxylic acid compound having 8 to 12 carbon atoms in an amount of from 70 to 100 mol % with an aqueous dispersion containing a non-crystalline resin (A) obtained by polycondensing an alcohol component and a carboxylic acid component containing at least one succinic acid compound selected from the group consisting of an alkyl ($C_9$ to $C_{18}$) succinic acid and an alkenyl ($C_9$ to $C_{18}$) succinic acid, and then aggregating the crystalline polyester and the non-crystalline resin (A) to prepare an aqueous solution of resin particles A;

Step 2: preparing an aqueous dispersion containing a non-crystalline resin (B) obtained by polycondensing a carboxylic acid component and an alcohol component containing an aliphatic dialcohol having 2 to 5 carbon atoms in an amount of 80 mol % or more;

Step 3: mixing the aqueous dispersion of the resin particles A prepared in the step 1 with the aqueous dispersion of the non-crystalline resin (B) prepared in the step 2 to aggregate the resin particles A and the non-crystalline resin (B), thereby preparing an aqueous dispersion of resin particles B; and Step 4: coalescing the resin particles B obtained in the step 3 to obtain coalesced particles thereof.

According to the above process, it is possible to produce the toner containing the resin binder in the form of core/shell particles in which the core portion contains the crystalline polyester and the non-crystalline resin (A), and the shell portion contains the non-crystalline resin (B). Meanwhile, the shell portion may also contain other resins unless the effects of the present invention are adversely affected.

<Step 1>

In the step 1, an aqueous dispersion containing the crystalline polyester and an aqueous dispersion containing the non-crystalline resin (A) are separately prepared, and mixed and aggregated together to prepare an aqueous solution of resin particles A. The processes for producing the crystalline polyester and the non-crystalline resin (A) are respectively the same as described above.

Meanwhile, the term "aqueous" as used herein means that it may also contain a solvent such as an organic solvent, but preferably contains water in an amount of 50% by weight or more, more preferably 70% by weight or more, still more preferably 90% by weight more and further still more preferably 99% by weight or more. Also, such a material as hereinafter referred to as merely the "resin" means both of the crystalline polyester and the non-crystalline resin.

The aqueous dispersion containing the crystalline polyester may be obtained by mixing the crystalline polyester, an organic solvent and water, if required, together with a neutralizing agent or a surfactant, stirring the resulting mixture, and then removing the organic solvent from the obtained dispersion by distillation and the like. Preferably, the crystalline polyester is first dissolved, if required, together with the surfactant, in the organic solvent, and then the resulting organic solvent solution is mixed with water and, if required, the neutralizing agent. The mixture of the respective components may be stirred using an ordinary mixing and stirring apparatus such as an anchor blade.

Examples of the organic solvent include alcohol solvents such as ethanol, isopropanol and isobutanol; ketone solvents such as acetone, 2-butanone, methyl ethyl ketone, methyl isobutyl ketone and diethyl ketone; ether solvents such as dibutyl ether, tetrahydrofuran and dioxane; and ethyl acetate. Among these organic solvents, preferred are ethyl acetate and 2-butanone from the viewpoint of a good dispersibility of the crystalline polyester therein.

Examples of the neutralizing agent include hydroxides of alkali metals such as lithium hydroxide, sodium hydroxide and potassium hydroxide; and organic bases such as ammonia, trimethyl amine, ethyl amine, diethyl amine, triethyl amine, methanol amine and tributyl amine.

Examples of the surfactant include anionic surfactants such as sulfate-based surfactants, sulfonate-based surfactants, phosphate-based surfactants and soap-based surfactants (such as alkyl ether carboxylic acid salts); cationic surfactants such as amine salt-type surfactants and quaternary ammonium salt-type surfactants; and the below-mentioned nonionic surfactants. The amount of the surfactant, if used, is preferably from 0.1 to 20 parts by weight and more preferably from 0.5 to 10 parts by weight on the basis of 100 parts by weight of the crystalline polyester.

The amount of the organic solvent to be mixed with the crystalline polyester is preferably from 100 to 1,000 parts by weight on the basis of 100 parts by weight of the crystalline polyester. The amount of water to be mixed with the crystalline polyester is preferably from 100 to 1,000 parts by weight on the basis of 100 parts by weight of the organic solvent.

The temperature used upon mixing the crystalline polyester in the organic solvent is preferably from 30 to 90° C. and more preferably from 40 to 80° C.

The solid content of the thus obtained aqueous dispersion containing the crystalline polyester may be controlled by adding an appropriate amount of water thereto, and is preferably controlled to the range of from 3 to 50% by weight, more preferably from 5 to 30% by weight and still more preferably from 7 to 15% by weight.

Further, the aqueous dispersion may also be prepared without using the organic solvent. For example, when the resin is mixed with a nonionic surfactant, a viscosity of the obtained mixture is decreased, and the resin and the nonionic surfactant are compatibilized with each other, so that an apparent softening point of the resin is lowered to thereby obtain a dispersion of the resin. By utilizing this phenomenon, the apparent softening point of the resin compatibilized with the nonionic surfactant can be decreased to a temperature not higher than a boiling point of water. As a result, even the resin having a melting point or softening point of 100° C. or higher by itself may be formed into a dispersion of the resin in water by dropping water thereto under normal pressures.

This method may be carried out in the presence of at least water and the nonionic surfactant and is therefore applicable to resins that are insoluble in an organic solvent. In addition, the method needs neither facilities for recovering the organic solvent and maintaining working environments nor special equipments that will be required upon employing mechanical means, resulting in such an advantage that the dispersion of resin particles can be produced in an economical manner.

Examples of the nonionic surfactant include polyoxyethylene alkyl aryl ethers such as polyoxyethylene nonyl phenyl ether; polyoxyethylene alkyl ethers such as polyoxyethylene oleyl ether and polyoxyethylene lauryl ether; polyoxyethylene sorbitan esters such as polyoxyethylene sorbitan monolaurate and polyoxyethylene sorbitan monostearate; polyoxyethylene fatty acid esters such as polyethylene glycol monolaurate, polyethylene glycol monostearate and polyethylene glycol monooleate; and oxyethylene/oxypropylene block copolymers. The nonionic surfactant may also be used in combination with an anionic surfactant or a cationic surfactant.

The nonionic surfactant is preferably selected from those having a good compatibility with the resin. In order to obtain a stable dispersion of the resin, the nonionic surfactant preferably has a HLB value of from 12 to 18. More preferably, two or more kinds of nonionic surfactants which are different in HLB from each other are used depending upon the kind of resin used. For example, when using the resin having a high hydrophilicity, the use of at least one kind of nonionic surfactant having a HLB value of from 12 to 18 may be sufficient to obtain a stable dispersion thereof. On the other hand, when using the resin having a high hydrophobicity, the nonionic surfactant having a low HLB value, for example, a HLB value of from about 7 to about 10, is preferably used in combination with the nonionic surfactant having a high HLB value, for example, a HLB value of from 14 to 20 so as to control a weighted mean HLB value of both the nonionic surfactants to from 12 to 18. In this case, it is suggested that the nonionic surfactant having a HLB value of about 7 to about 10 serves mainly for allowing the resin to become compatibilizable therewith, whereas the nonionic surfactant having a higher HLB value serves for stabilizing the dispersion of the resin in water.

When the resin is formed into fine particles in water under normal pressures, the cloud point of the nonionic surfactant is preferably from 70 to 105° C. and more preferably from 80 to 105° C.

The amount of the nonionic surfactant used is preferably 5 parts by weight or more on the basis of 100 parts by weight of the crystalline polyester from the viewpoint of decreasing a melting point of the resin, and is preferably 80 parts by weight or less on the basis of 100 parts by weight of the crystalline polyester from the viewpoint of controlling an amount of the nonionic surfactant remaining in the toner. Therefore, in view of achieving both the requirements, the amount of the nonionic surfactant used is preferably in the range of from 5 to 80 parts by weight, more preferably from 10 to 70 parts by weight and still more preferably from 20 to 60 parts by weight on the basis of 100 parts by weight of the crystalline polyester or non-crystalline resin.

The volume median particle size of the core-forming resin particles contained in the aqueous dispersion containing the core-forming resin particles is preferably from 50 to 1,000 nm, more preferably from 50 to 500 nm, still more preferably from 50 to 300 nm and further still more preferably from 80 to 200 nm from the viewpoint of uniformly aggregating the particles in the subsequent step 3. The volume median particle size of the resin particles may be measured by a laser diffraction type particle size measuring apparatus as described hereinlater, and the like.

The aqueous dispersion containing the non-crystalline resin (A) may also be produced by the same method as used for producing the above aqueous dispersion containing the crystalline polyester, and the preferred ranges of the production conditions, and the like, are also the same as those described for the above aqueous dispersion containing the crystalline polyester.

Next, the aqueous dispersion containing the crystalline polyester is mixed with the aqueous dispersion containing the non-crystalline resin (A), and then the resulting mixed dispersion is subjected to an aggregating step to aggregate the crystalline polyester and the non-crystalline resin (A), thereby preparing an aqueous dispersion of resin particles A.

The above aggregating step may also be carried out after further adding various additives such as, for example, a colorant, a charge controlling agent, a releasing agent, a conductivity modifier, an extender pigment, a reinforcing filler such as fibrous substances, an antioxidant and an anti-aging agent to the aqueous dispersion. These additives may also be used in the form of an aqueous dispersion.

The colorant is not particularly limited, and may be appropriately selected from known colorants according to the applications or requirements. Specific examples of the colorant include various pigments such as carbon blacks, inorganic composite oxides, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Aniline Blue, ultramarine blue, Calco Oil Blue, Methylene Blue Chloride, Phthalocyanine Blue, Phthalocyanine Green and Malachite Green Oxalate; and various dyes such as acridine dyes, xanthene dyes, azo dyes, benzoquinone dyes, azine dyes, anthraquinone dyes, indigo dyes, thioindigo dyes, phthalocyanine dyes, Aniline Black dyes, polymethine dyes, triphenylmethane dyes, diphenylmethane dyes, thiazine dyes and thiazole dyes. These colorants may be used alone or in combination of any two or more thereof. The amount of the colorant added is preferably from 0.1 to 20 parts by weight and more preferably from 1 to 10 parts by weight on the basis of 100 parts by weight of a total amount of the crystalline polyester and the non-crystalline resin (A) as the core-forming resin particles.

Examples of the charge controlling agent include chromium-based azo dyes, iron-based azo dyes, aluminum-based azo dyes and metal complexes of salicylic acid. These charge controlling agents may be used alone or in combination of any two or more thereof. The amount of the charge controlling agent added is preferably from 0.1 to 8 parts by weight and more preferably from 0.3 to 7 parts by weight on the basis of 100 parts by weight of a total amount of the crystalline polyester and the non-crystalline resin (A) as the core-forming resin particles.

Examples of the releasing agent include fatty acid amides such as oleamide, erucamide, ricinoleamide and stearamide; vegetable waxes such as carnauba wax, rice wax, candelilla wax, haze wax and jojoba oil; animal waxes such as beeswax; mineral and petroleum waxes such as montan wax, ozokerite, ceresin, microcrystalline wax and Fischer-Tropsch wax; polyolefin waxes; paraffin waxes; and silicones. These releasing agents may be used alone or in combination of any two or more thereof. The melting point of the releasing agent is preferably from 60 to 140° C. and more preferably from 60 to 100° C. from the viewpoints of a low-temperature fusing property, an anti-staining property for carriers and a charging rate of the resulting toner.

The amount of the releasing agent added is preferably from 0.5 to 10 parts by weight, more preferably from 1 to 8 parts by weight and still more preferably from 1 to 7 parts by weight on the basis of 100 parts by weight of a total amount of the crystalline polyester and the non-crystalline resin (A) as the core-forming resin particles in view of a good dispersibility in the resin.

The preferred mixing weight ratio between the crystalline polyester and the non-crystalline resin (A) is the same as the weight ratio described as to the above resin binder for toners.

The solid content in the reaction system used in the aggregating step is preferably from 5 to 50% by weight, more preferably from 5 to 30% by weight and still more preferably from 5 to 20% by weight in view of uniformly aggregating the particles.

The pH value of the reaction system used in the aggregating step is preferably from 2 to 10, more preferably from 2 to 9 and still more preferably from 3 to 8 from the viewpoint of achieving both of a good dispersion stability of the mixed solution and a good aggregating property of the resin particles.

From the same viewpoint as described above, the temperature of the reaction system in the aggregating step is preferably not lower than the temperature calculated from the "softening point of the resin binder in the core portion− (minus) 60° C." (this means the temperature lower by 60° C. than the softening point of the resin binder in the core portion; hereinafter defined in the same way) and not higher than the softening point of the resin binder in the core portion. In the present invention, since the crystalline polyester and the non-crystalline resin (A) are used in combination as the resin binder in the core portion, the softening point of the resin binder in the core portion is defined as a weighted mean value of softening points of the crystalline polyester and the non-crystalline resin (A). In addition, when using a master batch, the softening point of the resin binder in the form of a mixed resin is also determined from a weighted mean value of softening points of the resins including resins contained in the master batch.

In addition, the additives such as a colorant and a charge controlling agent may be previously mixed in the crystalline polyester or the non-crystalline resin (A) upon preparing the resin particles. Alternatively, the respective additives may be separately dispersed in a dispersing medium such as water to prepare respective dispersions, and the thus prepared additive dispersions may be mixed with the resin particles and subjected to the aggregating step. When the additives are previously mixed in the crystalline polyester or the non-crystalline resin (A) upon preparing the resin particles, the crystalline polyester or the non-crystalline resin (A) and the additives are preferably previously melt-kneaded with each other.

The melt-kneading is preferably carried out using an open roll type twin-screw kneader. The open roll type twin-screw kneader has two rolls arranged close to and parallel with each other through which a heating medium can be passed to impart a heating function or a cooling function thereto. Thus, since the open roll type twin-screw kneader has a melt-kneading section having an open structure and is equipped with a heating roll and a cooling roll, a kneading heat generated upon the melt-kneading can be readily released therefrom unlike the conventional twin-screw extruders.

In the aggregating step, in order to effectively carry out the aggregation, an aggregating agent may be added. As the organic aggregating agent, a cationic surfactant in the form of a quaternary salt, polyethyleneimine, or the like may be used, and as the inorganic aggregating agent, an inorganic metal salt, an inorganic ammonium salt, a divalent or higher-valent metal complex or the like may be used.

The inorganic metal salt includes, for example, metal salts such as sodium sulfate, sodium chloride, calcium chloride, calcium nitrate, barium chloride, magnesium chloride, zinc chloride, aluminum chloride and aluminum sulfate; and inorganic metal salt polymers such as poly(aluminum chloride), poly(aluminum hydroxide), and poly(calcium sulfide). Specific examples of the inorganic ammonium salt include ammonium sulfate, ammonium chloride and ammonium nitrate.

The amount of the aggregating agent added is preferably 60 parts by weight or less, more preferably 55 parts by weight or less and still more preferably 50 parts by weight or less on the basis of 100 parts by weight of the resin binder in the core portion, in view of a good environmental resistance of the resulting toner.

The aggregating agent is preferably added in the form of an aqueous solution prepared by dissolving the aggregating agent in an aqueous medium, and the mixture obtained during and after addition of the aggregating agent is preferably sufficiently stirred.

The mixture containing the aqueous dispersion containing the crystalline polyester and the aqueous dispersion containing the non-crystalline resin (A), if required, together with various additives is preferably subjected to dispersing treatment at a temperature lower than the softening point of the resin binder in the core portion and more preferably at a temperature not higher than the "softening point of the resin binder in the core portion− (minus) 30° C." from the viewpoint of obtaining a uniform dispersion. More specifically, the temperature used upon the dispersing treatment is preferably 65° C. or lower and more preferably 55° C. or lower. Also, the dispersing treatment is preferably carried out at a temperature higher than 0° C., and more preferably at a temperature of 10° C. or higher from the viewpoints of maintaining a good fluidity of the medium and saving an energy required for production of the aqueous dispersion of the respective resins.

From these viewpoints, the above mixture may be dispersed by an ordinary method such as dispersing treatment with stirring at a temperature of preferably from about 0 to about 65° C. and more preferably from about 10 to about 55° C., thereby enabling preparation of a uniform resin dispersion.

The dispersing treatment may be carried out using a high-speed mixer or stirrer such as "Ultra Disper" (tradename: available from Asada Iron Works Co., Ltd.), "Ebara Milder" (tradename: available from Ebara Corporation) and "TK Homomixer" (tradename: available from PRIMIX Corporation); a homo-valve-type high-pressure homogenizer such as typically "High-Pressure Homogenizer" (tradename: available from Izumi Food Machinery Co., Ltd.) and "Mini-Lab 8.3H Model" (tradename: available from Rannie Corp.); and a chamber-type high-pressure homogenizer such as "Micro Fluidizer" (tradename: available from Microfluidics Inc.) and "Nanomizer" (tradename: available from NANOMIZER Inc.).

The volume median particle size of the core-forming resin particles A obtained in the step 1 is preferably from 1 to 10 μm, more preferably from 2 to 8 μm and still more preferably from 3 to 7 μm from the viewpoint of uniformly coalescing the aggregated particles in the subsequent step 4 to produce toner particles.

<Step 2>

In the step 2, an aqueous dispersion containing the non-crystalline resin (B) is prepared. The method for producing the non-crystalline resin (B) is the same as described above, and the method for preparing the aqueous dispersion and the preferred properties thereof are also the same as described above.

<Step 3>

In the step 3, the aqueous dispersion of the core-forming resin particles A prepared in the step 1 is mixed with the aqueous dispersion of the non-crystalline resin (B) prepared in the step 2 to aggregate the resin particles A and the non-crystalline resin (B), thereby preparing an aqueous dispersion of resin particles B.

The volume median particle size of the particles contained in the non-crystalline polyester-containing aqueous dispersion to be mixed in the step 3 is adjusted as described above from the viewpoint of producing uniform core/shell particles.

The amount of the non-crystalline resin (B) to be mixed is preferably from 5 to 200 parts by weight, more preferably from 10 to 100 parts by weight and still more preferably from 10 to 50 parts by weight on the basis of 100 parts by weight of the resin particles A obtained in the step 1.

The weight ratio between the non-crystalline resin (A) in the resin particles A obtained in the step 1 and the non-crystalline resin (B) may be the same as that described previously.

The average particle size of the resin particles B obtained in the step 3 is controlled such that the volume median particle size thereof is preferably from 1 to 10 μm, more preferably from 2 to 8 μm and still more preferably from 3 to 7 μm from the viewpoint of obtaining uniform coalesced particles in the subsequent step 4 to produce toner particles. The aggregating conditions are the same as described in the step 1.

<Step 4>

In the step 4, the aqueous dispersion of the resin particles B prepared in the step 3 is subjected to a coalescing step, if required, after adding an aggregation stopping agent thereto, to coalesce the resin particles B in the aqueous dispersion, thereby obtaining an aqueous dispersion of coalesced particles.

In the step 4, the aggregated particles obtained in the step 3 are heated to obtain coalesced particles thereof.

The temperature of the reaction system in the step 4 is preferably not lower than the "softening point of the resin binder− (minus) 30° C." and not higher than the "softening point of the resin binder+ (plus) 10° C."; more preferably not lower than the "softening point of the resin binder− (minus) 25° C." and not higher than the "softening point of the resin binder+ (plus) 10° C."; and still more preferably not lower than the "softening point of the resin binder− (minus) 20° C." and not higher than the "softening point of the resin binder+ (plus) 10° C.", from the viewpoints of well controlling a particle size, a particle size distribution and a particle shape of the toner as target, and attaining a good fusibility of the aggregated particles. More specifically, the temperature of the reaction system in the step 4 is preferably kept in the range of from 40 to 90° C. and more preferably from 50 to 80° C. In addition, the stirring rate used in the step 4 is preferably a rate at which the aggregated particles are not precipitated. The "softening point of the resin binder" as used herein means the temperature as a weighted mean value of the softening point of the non-crystalline resin (A), the softening point of the non-crystalline resin (B) and the softening point of the crystalline polyester.

Meanwhile, if the aggregation stopping agent is added in the above step, a surfactant is preferably used as the aggregation stopping agent. The aggregation stopping agent is more preferably an anionic surfactant. Among the anionic surfactants, at least one compound selected from the group consisting of alkyl ether sulfates, alkyl sulfates and straight-chain alkylbenzenesulfonates is still more preferably used.

After coalescing and cooling the particles, the resulting coalesced particles are preferably heated to the temperature of from the "melting point of the crystalline polyester− (minus) 10° C." to the "melting point of the crystalline polyester− (minus) 30° C." which is also in the range of from 40° C. to the "coalescing temperature− (minus) 10° C.".

[Toner for Electrophotography]

The toner for electrophotography according to the present invention (hereinafter referred to merely as a "toner") may be produced by appropriately subjecting the coalesced particles obtained in the step 4 to a liquid-solid separation step such as filtration, a washing step and a drying step.

In the washing step, the coalesced particles are preferably washed with an acid to remove metal ions from the surface of the respective toner particles for the purpose of ensuring sufficient charging characteristics and a good reliability required for the resulting toner. In the washing step, the coalesced particles are preferably washed to such an extent that the nonionic surfactant added is also completely removed therefrom. In addition, the coalesced particles are preferably washed with an aqueous solution at a temperature not higher than a cloud point of the nonionic surfactant. The washing procedure is preferably repeated a plurality of times.

In addition, in the drying step, any optional methods such as vibration-type fluidization drying method, spray-drying method, freeze-drying method and flash jet method may be employed. The content of water in the toner obtained after drying is preferably adjusted to 1.5% by weight or less and more preferably 1.0% by weight or less from the viewpoint of a good charging property of the resulting toner.

The thus obtained toner has a low fusibility when treated with an external additive. Therefore, an auxiliary agent such as a fluidizing agent can be readily added as the external additive to the surface of the respective toner particles. As the external additive, there may be used known fine particles. Examples of the fine particles as the external additive include inorganic fine particles such as fine silica particles whose surface is subjected to a hydrophobic treatment, fine titanium oxide particles, fine alumina particles, fine cerium oxide particles and carbon blacks; and fine polymer particles such as fine particles of polycarbonates, polymethyl methacrylate, silicone resins.

The number-average particle size of the external additive is preferably from 4 to 200 nm and more preferably from 8 to 30 nm. The number-average particle size of the external additive may be determined using a scanning electron microscope or a transmission electron microscope.

The amount of the external additive added to the toner is preferably from 0.8 to 5 parts by weight, more preferably from 1 to 5 parts by weight and still more preferably from 1.5 to 3.5 parts by weight on the basis of 100 parts by weight of the toner before being treated with the external additive from the viewpoints of a good environmental stability of charging rate and a good storage stability under load. However, when a hydrophobic silica is used as the external additive, the hydrophobic silica is added in an amount of from 0.8 to 3.5 parts by weight and preferably from 1 to 3 parts by weight on the basis of 100 parts by weight of the toner before being treated with the external additive to attain the above desired effects.

(Properties of Toner for Electrophotography)

The volume median particle size of the toner for electrophotography according to the present invention is preferably from 1 to 10 μm, more preferably from 2 to 8 μm and still more preferably from 3 to 7 μm from the viewpoints of a high image quality and a high productivity of the toner.

The softening point of the toner is preferably from 80 to 160° C., more preferably from 80 to 150° C. and still more preferably from 90 to 140° C. from the viewpoints of a low-temperature fusing property, an anti-staining property for carriers and a charging rate of the resulting toner. In addition, the glass transition temperature of the toner is preferably from 45 to 80° C. and more preferably from 50 to 70° C. from the same viewpoints.

The toner for electrophotography according to the present invention may be used in the form of a one-component system developer or a tow-component system developer formed by mixing the toner with a carrier.

The toner containing the resin binder for toners according to the present invention is excellent in low-temperature fusing property, anti-staining property for carriers, and charging rate.

EXAMPLES

Various properties of the resins and the like were measured by the following methods.

<Softening Point of Resin>

Using a flow tester "CFT-500D" (tradename) available from Shimadzu Corporation, 1 g of a sample was extruded through a nozzle having a die pore size of 1 mm and a length of 1 mm while heating the sample at a temperature rise rate of 6° C./min and applying a load of 1.96 MPa thereto with a plunger of the flow tester. The softening point of the sample was determined as the temperature at which a half amount of the sample was flowed out when plotting a downward movement of the plunger of the flow tester relative to temperature.

<Endothermic Maximum Peak Temperature and Melting Point of Resin>

Using a differential scanning calorimeter (DSC; "Q-100" (tradename) available from TA Instruments Japan Inc.), a sample was cooled from room temperature (20° C.) to 0° C. at a temperature drop rate of 10° C./min, allowed to stand as such at 0° C. for 1 min, and then heated up to 180° C. at a temperature rise rate of 10° C./min to measure an endothermic curve thereof. The temperature of the peak present on the highest temperature side among the endothermic peaks observed in the curve was determined as the endothermic maximum peak temperature. If the difference between the maximum peak temperature and the softening point was within 20° C., the maximum peak temperature was determined as a melting point of the crystalline polyester.

<Glass Transition Temperature of Non-Crystalline Resin>

Using a differential scanning calorimeter ("Q-100" (tradename) available from TA Instruments Japan Inc.), a sample was weighed in an amount of 0.01 to 0.02 g on an aluminum pan, heated to 200° C., cooled from 200° C. to 0° C. at a temperature drop rate of 10° C./min, and further heated again at a temperature rise rate of 10° C./min to prepare an endothermic curve thereof. The glass transition temperature of the sample was determined from the endothermic curve by reading out the temperature at which an extension of a base line below the endothermic maximum peak temperature intersects a tangential line having a maximum inclination in a region from a raise-up portion to an apex of the peak in the curve.

<Acid Value of Resin>

The acid value of the resin was determined by the method according to JIS K 0070. However, only with respect to the solvent for the measurement, the mixed solvent of ethanol and ether as prescribed in JIS K 0070 was replaced with a mixed solvent containing acetone and toluene at a volume ratio of 1:1.

<Volume Median Particle Sizes ($D_{50}$) of Resin Particles, Colorant Fine Particles, Releasing Agent Fine Particles and Charge Controlling Agent Fine Particles>

Using a laser diffraction particle size analyzer "LA-920" (tradename) commercially available from HORIBA, Ltd., a cell for the measurement was filled with distilled water, and a volume median particle size ($D_{50}$) of the particles was measured at a concentration at which an absorbance thereof was within an adequate range.

Production Example 1

Production of Alkylene Compound A

A propylene tetramer (tradename "Light Tetramer") available from Nippon Oil Corporation was subjected to fractional distillation under the heating condition at a temperature of from 183 to 208° C. to obtain an alkylene compound A. As a result of subjecting the thus obtained alkylene compound A to the below-mentioned gas chromatography-mass spectrometry, it was confirmed that 40 peaks were observed in a characteristic curve thereof. The analysis results of the alkylene compound A are as follows: $C_9H_{18}$: 0.5% by weight; $C_{10}H_{20}$: 4% by weight; $C_{11}H_{22}$: 20% by weight; $C_{12}H_{24}$: 66% by weight; $C_{13}H_{26}$: 9% by weight; $C_{14}H_{28}$: 0.5% by weight.

[Gas Chromatography-Mass Spectrometry of Alkylene Compound A]

A gas chromatograph mass spectrometer (GC/MS) was mounted with a CI ion source and the following analyzing column, and subjected to start-up operation. Meanwhile, the analyzer was tuned after the elapse of 24 hours from initiation of evacuation work of a MS section while flowing a CI reaction gas (methane) therethrough.

(1) GC

Gas chromatograph: "HP6890N" (tradename) available from Agilent Technologies, Inc. Column: "Ultra 1" (tradename; column length: 50 m; inner diameter: 0.2 mm; film thickness: 0.33 μm) available from Hewlett-Packard Company GC oven heating conditions:

Initial temperature: 100° C. (0 min)

First stage temperature rise rate: 1° C./min (up to 150° C.)

Second stage temperature rise rate: 10° C./min (up to 300° C.)

Final temperature: 300° C. (10 min)

Amount of Sample Injected: 1 μL

Injection port conditions:

Injection mode: Split method

Split ratio: 50:1

Injection port temperature: 300° C.

Carrier gas:

Gas: Helium

Flow rate: 1 mL/min (constant flow rate mode)

(2) Detector

Mass spectrometer: "5973N MSD" (tradename) available from Agilent Technologies, Inc.

Ionization method: Chemical ionization method

Reaction gas: Isobutane

Temperatures set:

Quadrupole: 150° C.

Ion source: 250° C.

Detection conditions: scanning

Scanning range: m/z 75 to 300

ON time of detector: 5 min

Calibration (mass calibration and sensitivity adjustment):

Reaction gas: Methane

Calibrant: PFDTD (perfluoro-5,8-dimethyl-3,6,9-trioxydodecane)

Tuning method: Auto-tuning (3) Preparation of Sample

Propylene tetramer was dissolved in isopropyl alcohol to prepare a sample solution having a propylene tetramer concentration of 5% by weight.

(Data Processing Method)

Respective alkene components having 9 to 14 carbon atoms were subjected to extraction of mass chromatograms based on mass numbers corresponding to the respective molecular ions. The extracted mass chromatograms were integrated under the integration conditions for each component as shown in Tables 2 to 5 and under the condition of S/N (signal/noise ratio)>3. From the detection results as shown in Table 1, the proportion of specific alkyl chain length components is calculated according to the following formula.

Proportion of specific alkyl chain length components (%)=[(Sum of integrated values of specific alkyl chain length components)/(Sum of integrated values of alkenes having 9 to 14 carbon atoms)]×100

TABLE 1

| | Molecular weight (Mw) | Molecular ion (M/Z) | Monitor mass range (M/Z-M/Z) |
|---|---|---|---|
| $C_9H_{18}$ | 126 | 127 | 126.70-127.70 |
| $C_{10}H_{20}$ | 140 | 141 | 140.70-141.70 |
| $C_{11}H_{22}$ | 154 | 155 | 154.70-155.70 |
| $C_{12}H_{24}$ | 168 | 169 | 168.70-169.70 |
| $C_{13}H_{26}$ | 182 | 183 | 182.70-183.70 |
| $C_{14}H_{28}$ | 196 | 197 | 196.70-197.70 |

TABLE 2

| Integration conditions | Values (V) | Time (T) |
|---|---|---|
| Initial Area Reject | 0 | Initial |
| Initial Peak Width | 0.200 | Initial |
| Shoulder Detection | OFF | Initial |
| Initial Threshold | 5.0 | Initial |
| Peak Width | 2.000 | 5.000 |

TABLE 3

| Integration conditions | Values (V) | Time (T) |
|---|---|---|
| Initial Area Reject | 0 | Initial |
| Initial Peak Width | 0.200 | Initial |
| Shoulder Detection | OFF | Initial |
| Initial Threshold | 7.0 | Initial |
| Peak Width | 2.000 | 5.000 |

Components: $C_{11}H_{22}$, $C_{12}H_{24}$ and $C_{13}H_{26}$

TABLE 4

| Integration conditions | Values (V) | Time (T) |
|---|---|---|
| Initial Area Reject | 0 | Initial |
| Initial Peak Width | 0.200 | Initial |
| Shoulder Detection | OFF | Initial |
| Initial Threshold | 7.0 | Initial |
| Peak Width | 2.000 | 5.000 |

TABLE 5

| Integration conditions | Values (V) | Time (T) |
|---|---|---|
| Initial Area Reject | 0 | Initial |
| Initial Peak Width | 0.200 | Initial |
| Shoulder Detection | OFF | Initial |
| Initial Threshold | 5.0 | Initial |
| Peak Width | 2.000 | 11.000 |

In the present invention, the alkylene compounds having 9 to 14 carbon atoms mean those compounds having peaks corresponding to respective molecular ions as measured by gas chromatography/mass spectrometry.

Production Example 2

Production of Alkenyl Succinic Anhydride A

A 1-L autoclave available from Nitto Kouatsu Co., Ltd., was charged with 542.4 g of the alkylene compound A, 157.2 g of maleic anhydride, 0.4 g of "Chelex-O" (tradename) available from Sakai Chemical Industry Co., Ltd., and 0.1 g of butyl hydroquinone, and an interior of the autoclave was replaced with pressurized nitrogen (0.2 MPaG) three times. After stirring was initiated at 60° C., the contents of the autoclave were heated up to 230° C. over 1 hour, and then reacted with each other at 230° C. for 6 hours. The pressure upon reaching the reaction temperature was 0.3 MPaG. After completion of the reaction, the resulting reaction solution was cooled to 80° C., and after the pressure of the reaction system was returned to normal pressures (101.3 kPa), the reaction solution was transferred into a 1-L four-necked flask. The reaction solution in the flask was heated to 180° C. while stirring, and the residual alkylene compound was distilled off therefrom under a pressure of 1.3 kPa over 1 hour. Successively, the reaction solution was cooled to room temperature (25° C.), and then the pressure within the flask was returned to normal pressures (101.3 kPa), thereby obtaining 406.1 g of an alkenyl succinic anhydride A as the target product. The average molecular weight of the alkenyl succinic anhydride A as calculated from an acid value thereof was 268.

Production Examples 3, 5, 6 and 8

Production of Non-Crystalline Resins A1, B1, B2 and B4

The raw materials as shown in Table 6 except for trimellitic anhydride, 40 g of tin octylate and 2 g of gallic acid, were charged into a 10-L four-necked flask equipped with a nitrogen inlet tub; a dehydration tube having a fractional distillation tube through which a hot water at 98° C. was flowed, a stirrer and a thermocouple. In a nitrogen atmosphere, the contents of the flask were heated from 180° C. to 210° C. at a temperature rise rate of 10° C./h, and then subjected to polycondensation reaction at 210° C. until reaching a reaction rate of 90%. Thereafter, trimellitic anhydride was added to the resulting reaction solution, and the resulting mixture was reacted at 210° C. under normal pressures for 1 hour, and then further reacted under a pressure of 20 kPa until reaching the softening point shown in Table 6 to thereby produce non-crystalline resins A1, B1, B2 and B4.

Production Examples 4 and 7

Production of Non-Crystalline Resins A2 and B3

The raw materials as shown in Table 6 except for trimellitic anhydride, 40 g of tin octylate and 2 g of gallic acid, were charged into a 10-L four-necked flask equipped with a nitrogen inlet tube, a dehydration tube, a stirrer and a thermocouple. The contents of the flask were reacted with each other at 230° C. over 8 hours, and then reacted under a pressure of 8.3 kPa for 1 h. Further, trimellitic anhydride was added to the resulting reaction solution at 210° C., and the resulting mixture was reacted at 210° C. until reaching the softening point shown in Table 6 to thereby produce non-crystalline resins A2 and B3.

TABLE 6

| | Production Examples | | | | | | | | | | | |
|---|---|---|---|---|---|---|---|---|---|---|---|---|
| | 3 | | 4 | | 5 | | 6 | | 7 | | 8 | |
| Non-crystalline resin | A1 | | A2 | | B1 | | B2 | | B3 | | B4 | |
| Raw monomers | g | mol %*3 | g | mol %*3 | g | mol %*3 | g | mol %*3 | g | mol %*3 | g | mol %*3 |
| (Alcohol component) | | | | | | | | | | | | |
| BPA-PO*1 | — | — | 4410 | 70 | — | — | — | — | 4655 | 70 | — | — |
| BPA-EO*2 | — | — | 1755 | 30 | — | — | — | — | 1853 | 30 | — | — |
| 1,2-Propanediol | 3040 | 100 | — | — | 3192 | 100 | 3192 | 100 | — | — | — | — |
| Ethylene glycol | — | — | — | — | — | — | — | — | — | — | 1304 | 50 |
| Neopentyl glycol | — | — | — | — | — | — | — | — | — | — | 2184 | 50 |
| (Acid component) | | | | | | | | | | | | |
| Terephthalic acid | 3320 | 50 | 1554 | 52 | 4532 | 65 | 5229 | 75 | 2366 | 75 | 5229 | 75 |
| Alkenyl succinic anhydride A | 1608 | 15 | 965 | 20 | — | — | — | — | — | — | — | — |
| Trimellitic anhydride | 1536 | 20 | 691 | 20 | 1613 | 20 | 806 | 10 | 365 | 10 | 806 | 10 |
| Properties | | | | | | | | | | | | |
| Softening point (° C.) | 124.8 | | 126.2 | | 131.6 | | 101.6 | | 99.7 | | 102.3 | |
| Acid value (mgKOH/g) | 23.2 | | 22.7 | | 24.3 | | 21.5 | | 21.4 | | 22.5 | |
| Glass transition temperature (° C.) | 62.0 | | 62.4 | | 68.9 | | 61.5 | | 60.1 | | 59.9 | |

Note

*1BPA-PO: Polyoxypropylene (2.2) adduct of bisphenol A

*2BPA-EO: Polyoxyethylene (2.0) adduct ofbisphenol A

*3Mol %: Molar ratio based on a total amount (moles) of whole alcohol components as 100.

Production Example 9

Production of Crystalline Polyester aa

The raw monomers as shown in Table 7 were charged into a 10-L four-necked flask equipped with a nitrogen inlet tube, a dehydration tube having a fractional distillation tube through which a hot water at 98° C. was flowed, a stirrer and a thermocouple. In a nitrogen atmosphere, the contents of the flask were heated to 140° C. and reacted with each other at 140° C. for 6 hours, and then further reacted while heating to 200° C. at a temperature rise rate of 10° C./h. After being reacted at 200° C. until reaching a reaction rate of 80%, 20 g of tin 2-ethylhexanoate were added to the resulting reaction solution, and the resulting mixture was reacted at 200° C. for 2 hours and then further reacted under a pressure of 8 kPa for 2 hours, thereby obtaining a resin. The thus obtained resin was cooled to 40° C. over 2 hours, and then heated again and held in a thermostat maintained at 60° C. and 50% RH for 8 hours, thereby obtaining a crystalline polyester.

Production Examples 10 to 12

Production of Crystalline Polyesters bb to dd

The raw monomers as shown in Table 7 were charged into a 10-L four-necked flask equipped with a nitrogen inlet tube, a dehydration tube, a stirrer and a thermocouple. The contents of the flask were heated to 140° C. and reacted with each other at 140° C. for 6 hours, and then further reacted while heating to 200° C. at a temperature rise rate of 10° C./h. After being reacted at 200° C. until reaching a reaction rate of 80%, 20 g of tin 2-ethylhexanoate were added to the resulting reaction solution, and the resulting mixture was reacted at 200° C. for 2 hours and then further reacted under a pressure of 8 kPa for 2 hours, thereby obtaining a resin. The thus obtained resin was cooled to 40° C. over 2 hours, and then heated again and held in a thermostat maintained at 60° C. and 50% RH for 8 hours, thereby obtaining respective crystalline polyesters.

Production Example 13

Production of Crystalline Polyester ee

The raw monomers as shown in Table 7 were charged into a 10-L four-necked flask equipped with a nitrogen inlet tube, a dehydration tube, a stirrer and a thermocouple. In a nitrogen atmosphere, the contents of the flask were heated to 140° C. and reacted with each other at 140° C. for 6 hours, and then further reacted while heating to 200° C. at a temperature rise rate of 10° C./h. After being reacted at 200° C. until reaching a reaction rate of 80%, 20 g of tin 2-ethylhexanoate were added to the resulting reaction solution, and the resulting mixture was reacted at 200° C. for 2 hours and then further reacted under a pressure of 8 kPa for 2 hours, thereby obtaining a resin.

TABLE 7

| | Production Examples | | | | | | | | | |
|---|---|---|---|---|---|---|---|---|---|---|
| Crystalline polyester | 9 aa | | 10 bb | | 11 cc | | 12 dd | | 13 ee | |
| Raw monomers | g | mol %*4 | g | mol %*4 | g | mol %*4 | g | mol %*4 | g | mol %*4 |
| (Alcohol component) | | | | | | | | | | |
| Ethylene glycol | 2236 | 100 | — | — | — | — | — | — | — | — |
| 1,6-Hexanediol | — | — | 3540 | 100 | — | — | — | — | 3540 | 100 |
| 1,9-Nonanediol | — | — | — | — | 4008 | 100 | — | — | — | — |
| 1,12-Dodecanediol | — | — | — | — | — | — | 4646 | 100 | — | — |
| (Acid component) | | | | | | | | | | |
| Sebacic acid | 7647 | 105 | 6372 | 105 | 5310 | 105 | 4886 | 105 | 6372 | 105 |
| Properties | | | | | | | | | | |
| Softening point (° C.) | 79.8 | | 70.5 | | 73.4 | | 82.7 | | 68.3 | |
| Acid value (mgKOH/g) | 30.3 | | 29.8 | | 27.6 | | 31.4 | | 29.6 | |
| Endothermic maximum peak temperature; melting point (° C.) | 76.4 | | 68.7 | | 71.7 | | 80.0 | | 65.4 | |

Note
*4Mol %: Molar ratio based on a total amount (moles) of whole alcohol components as 100.

Production Examples 14 to 24

Preparation of Dispersion of Resin Particles

A 5-L container equipped with a stirrer, a reflux condenser, a dropping funnel, a thermometer and a nitrogen inlet tube was charged with 600 g of methyl ethyl ketone, and then 200 g of the respective non-crystalline resins A1, A2 and B1 to B4 obtained in Production Examples 3 to 8 and 200 g of the respective crystalline polyesters aa to ee obtained in Production Examples 9 to 13 were added thereinto at 60° C. to dissolve the non-crystalline resin and the crystalline polyester in methyl ethyl ketone. The thus obtained respective solutions were neutralized by adding 4 g of sodium hydroxide thereto. Successively, 2000 g of ion-exchanged water were added to the respective solutions, and then methyl ethyl ketone was distilled off therefrom while stirring at a rate of 250 r/min under reduced pressure at a temperature of 50° C. or lower, thereby obtaining aqueous dispersions of self-dispersible resin particles (resin content: 9.6% by weight (in terms of a solid content)). The volume median particle size of the resin particles dispersed in each of the thus obtained aqueous dispersions was about 0.3 μm.

Production Example 25

Preparation of Colorant Dispersion

Fifty grams of copper phthalocyanine ("ECB-301" (Model No.) available from Dainichiseika Color & Chemicals Mfg. Co., Ltd.), 5 g of a nonionic surfactant ("EMULGEN 150" (tradename) available from Kao Corporation) and 200 g of ion-exchanged water were mixed with each other to dissolve the copper phthalocyanine. The resulting solution was dispersed for 10 min using a homogenizer, thereby obtaining a colorant dispersion. The colorant particles contained in the thus obtained colorant dispersion had a volume median particle size of 120 nm.

Production Example 26

Preparation of Wax Dispersion

Fifty grams of a paraffin wax ("HNP 0190" (tradename) available from NIPPON SEIRO Co., Ltd.; melting point; 85° C.), 5 g of a cationic surfactant ("SANISOL B50" (tradename) available from Kao Corporation) and 200 g of ion-exchanged water were mixed and heated to 95° C., and then the paraffin wax was dispersed in the mixture using a homogenizer. The resulting dispersion was subjected to dispersing treatment using a pressure injection type homogenizer, thereby obtaining a wax dispersion. The paraffin wax particles contained in the thus obtained wax dispersion had a volume median particle size of 550 nm.

Production Example 27

Preparation of Charge Controlling Agent Dispersion

Fifty grams of a charge controlling agent ("BONTRON E-84" (tradename) available from Orient Chemical Industries Co., Ltd.), 5 g of a nonionic surfactant ("EMULGEN 150" (tradename) available from Kao Corporation) and 200 g of ion-exchanged water were mixed with each other. The resulting mixture was dispersed with glass beads using a sand grinder for 10 min to obtain a charge controlling agent dispersion. The charge controlling agent particles contained in the thus obtained charge controlling agent dispersion had a volume median particle size of 500 nm.

Examples 1 to 8 and Comparative Examples 1 and 2

Production of Dispersion of Core/Shell Resin Particles and Toner

A round stainless steel flask was charged with 440 g of the core resin dispersion and 60 g of the crystalline polyester dispersion which were formulated in combination with each other as shown in Table 8, as well as 20 g of the colorant dispersion, 5 g of the wax dispersion, 4 g of the charge controlling agent dispersion and 1.5 g of a cationic surfactant ("SANISOL B50" (tradename) available from Kao Corporation). The contents of the flask were mixed and dispersed using a homogenizer, and then heated to 48° C. in a heating oil bath while stirring, and further held at 48° C. for 1 hour, thereby forming aggregated particles. The thus obtained aggregated particles had a volume median particle size of 5.1 μm. Thereafter, 100 g of the shell resin dispersion as shown in Table 8 were added to the resulting reaction mixture, and the obtained dispersion was dispersed while stirring, thereby obtaining aggregated particles in the form of capsulated core/shell particles.

After adding 3 g of an anionic surfactant ("PELEX SS-L" (tradename) available from Kao Corporation) to the dispersion of the aggregated particles in the form of core/shell aggregated particles, a reflux tube was mounted to the stainless steel flask, and the dispersion was heated to 80° C. at a temperature rise rate of 0.1° C./min while continuously stirring and held at 80° C. for 20 hours to coalesce and fuse the aggregated particles. Thereafter, the resulting dispersion was cooled to 30° C. and held at 30° C. for 20 min, and then heated to 50° C. and held at 50° C. for 2 hours. Thereafter, the obtained dispersion was cooled again and then filtered to separate the fused particles therefrom. The thus separated particles were sufficiently washed with ion-exchanged water and then dried, thereby obtaining colored resin fine particles. All of the thus obtained colored resin fine particles had a volume median particle size ($D_{50}$) of about 5.0 μm.

Next, 100 parts by weight of the toner mother particles were mixed and externally added with 0.5 parts by weight of an external additive "AEROSIL R972" (tradename) (hydrophobic silica; available from Nippon Aerosil Co., Ltd.) using a Henschel mixer at 3600 r/min for 5 min, thereby obtaining a toner composed of toner particles (volume median particle size $D_{50}$: 5.0 μm).

[Evaluation]

<Low-Temperature Fusing Property>

The toner was loaded to a copying machine "AR-505" available from Sharp Corporation, to obtain an unfused image (printed area: 2 cm×12 cm; amount of the toner deposited: 0.5 mg/cm$^2$). Further, the above image printing operation was performed on the same paper twice to obtain a printed layer having a thickness of 1.5 mg/cm$^2$.

With a fuser of the copying machine being set to Off-Line, the unfused image was fused on the paper at a rate of 300 mm/s while increasing the fusing temperature from 90° C. to 240° C. at intervals of 5° C. Meanwhile, "Copy Bond SF-70NA" (tradename: available from Sharp Corporation; 75 g/m$^2$) was used as the fusing paper. The fused image obtained by passing the paper through the fuser was rubbed with a sand eraser having a bottom surface area of 15 mm×7.5 mm by reciprocating the eraser over the fused image 5 times while applying a load of 500 g thereto. Then, optical reflection density values of the fused image before and after rubbing, were measured using a reflection-type densitometer "RD-915" (tradename) available from GretagMacbeth Corporation. From the thus measured values, a minimum fusing temperature of the toner was determined as the temperature of a fusing roll at which a ratio between the optical reflection density values of the fused image before and after rubbing (after rubbing/before rubbing) first exceeded 80%. Meanwhile, under the condition that the printed layer has a large thickness, if the crystals are insufficiently dispersed and partially remains undissolved, the layer tends to be peeled off.

The minimum fusing temperature thus measured was scored to evaluate a low-temperature fusing property of the toner, according to the following evaluation criteria. Meanwhile, the scores of 3 or more are practically acceptable.

5: Minimum fusing temperature was lower than 125° C.;

4: Minimum fusing temperature was not lower than 125° C. but lower than 130° C.;

3: Minimum fusing temperature was not lower than 130° C. but lower than 140° C.;

2: Minimum fusing temperature was not lower than 140° C.

(Anti-Staining Property for Carriers)

A developer prepared by mixing 3 parts by weight of the toner and 97 parts by weight of a silicone-coated ferrite carrier having an average particle size of 90 μm (available from Kanto Denka Kogyo Co., Ltd.) was loaded to a copying machine "Preter 50" (tradename: available from RICOH Co., Ltd.). After images having a printing percentage of 5% were continuously printed for 2 hours, the developer in the form of a mixture of the toner and the carrier was withdrawn from the copying machine, and passed through a 32-μm mesh sieve to suck the toner portion and separate the carrier portion therefrom. The thus obtained carrier was subjected to measurement of an amount of carbon attached thereonto using a carbon analyzer "EMIA-110" (tradename: available from HORIBA, Ltd.), and a difference between the thus measured carbon amount and a carbon amount on the carrier previously measured before mixing the carrier with the toner was determined to evaluate an anti-staining property for carriers of the toner according to the following evaluation criteria. That is, it is recognized that as the difference between the carbon amounts increases, the amount of the toner attached to the carrier becomes larger. Meanwhile, the scores of 3 or more are practically acceptable.

5: The difference between the carbon amounts was not more than 0.15.

3: The difference between the carbon amounts was more than 0.15 and less than 0.3.

1: The difference between the carbon amounts was not less than 0.3.

(Charging Rate)

A 50 mL wide-mouthed PP Sanpla bottle (tradename: available from Sanplatec Corporation) was charged with 0.6 g of the toner and 19.4 g of the ferrite carrier, and after the contents of the bottle were stirred for 20 min using a ball mill, a charge amount distribution of the toner was measured using a charge amount measuring apparatus ("q-test" (tradename) available from Epping GmbH). The above measurement was carried out under the following conditions.

Toner Flow (mL/min): 160

Electrode Voltage (V): 4000

Deposition Time (s): 2

From the obtained results, a graph concerning the charge amount distribution was prepared by drawing lines connecting between plots in the range of q/d −0.4 (fc/10 μm) to 0.4.

The percentage of weak charging in the range of −1.0 to 1.0 in the charge amount distribution was scored according to the following evaluation criteria. Meanwhile, the scores of 3 or more are practically acceptable.

5: The percentage of weak charging in the range of −1.0 to 1.0 was less than 3%.

4: The percentage of weak charging in the range of −1.0 to 1.0 was not less than 3% and less than 5%.

3: The percentage of weak charging in the range of −1.0 to 1.0 was not less than 5% and less than 10%.

2: The percentage of weak charging in the range of −1.0 to 1.0 was not less than 10%.

TABLE 8

| | | Examples | | | | | | | | Comparative Examples | |
|---|---|---|---|---|---|---|---|---|---|---|---|
| | | 1 | 2 | 3 | 4 | 5 | 6 | 7 | 8 | 1 | 2 |
| Core portion | Crystalline polyester dispersion | aa | bb | cc | dd | bb | bb | bb | ee | bb | bb |

TABLE 8-continued

| | | Examples | | | | | | | | Comparative Examples | |
|---|---|---|---|---|---|---|---|---|---|---|---|
| | | 1 | 2 | 3 | 4 | 5 | 6 | 7 | 8 | 1 | 2 |
| | Core resin dispersion | A1 | A1 | A1 | A1 | A1 | A2 | A1 | A1 | A1 | A2 |
| Shell portion | Shell resin dispersion | B2 | B2 | B2 | B2 | B1 | B2 | B4 | B2 | B3 | B3 |
| Evaluation | Low-temperature fusing property | 4 | 5 | 4 | 3 | 4 | 3 | 4 | 4 | 4 | 4 |
| | Anti-staining property for carriers | 3 | 5 | 5 | 5 | 5 | 5 | 5 | 3 | 1 | 1 |
| | Charging rate | 5 | 5 | 5 | 3 | 4 | 3 | 4 | 3 | 3 | 2 |

In the toners obtained in Comparative Examples 1 and 2 in which the resin B3 obtained using the alcohol component containing no aliphatic dialcohol having 2 to 5 carbon atoms was used as the non-crystalline resin in the shell portion, it is considered that the crystalline polyester in the core portion had a high compatibility with the non-crystalline resin in the shell portion and was therefore migrated into the shell portion, so that the respective toners were deteriorated in anti-staining property for carriers.

On the other hand, in the toners obtained in Examples 1 to 8, it was confirmed that the toners all were excellent in low-temperature fusing property, anti-staining property for carriers and a charging rate. From the comparison between Examples 2 and 5, it was also confirmed that when the softening point of the non-crystalline resin in the shell portion was lower than the softening point of the non-crystalline resin in the core portion, the resulting toner was more excellent in low-temperature fusing property and charging rate. In addition, from the comparison between Examples 2 and 6, it was confirmed that when the alcohol component of the non-crystalline resin in the core portion contained the aliphatic dialcohol having 2 to 5 carbon atoms in an amount of 80 mol % or more, the resulting toner was still more excellent in low-temperature fusing property and charging rate.

INDUSTRIAL APPLICABILITY

The toner containing the resin binder according to the present invention is excellent in low-temperature fusing property, anti-staining property for carriers and a charging rate, and can be therefore suitably used as a toner for electrophotography which is employed in an electrophotographic method, an electrostatic recording method, an electrostatic printing method and the like.

The invention claimed is:

1. A resin binder for toners, comprising core/shell particles each comprising a core portion containing a crystalline polyester obtained by polycondensing an alcohol component containing an aliphatic diol having 2 to 12 carbon atoms and a carboxylic acid component containing an aliphatic dicarboxylic acid compound having 8 to 12 carbon atoms in an amount of from 70 to 100 mol %, and a non-crystalline resin (A) obtained by polycondensing an alcohol component and a carboxylic acid component containing at least one succinic acid compound selected from the group consisting of an alkyl ($C_9$ to $C_{18}$) succinic acid and an alkenyl ($C_9$ to $C_{18}$) succinic acid in an amount of from 3 to 60 mol %; and a shell portion containing a non-crystalline resin (B) obtained by polycondensing a carboxylic acid component and an alcohol component containing an aliphatic dialcohol having 2 to 5 carbon atoms in an amount of 80 mol % or more;

wherein the carboxylic acid component of the non-crystalline resin (B) contained in the shell portion contains at least one succinic acid compound selected from the group consisting of an alkyl ($C_9$ to $C_{18}$) succinic acid and an alkenyl ($C_9$ to $C_{18}$) succinic acid in an amount of 2 mol % or less; and wherein the non-crystalline resin (B) contained in the shell portion has a softening point lower than a softening point of the non-crystalline resin (A) contained in the core portion.

2. The resin binder for toners according to claim 1, wherein the alcohol component of the non-crystalline resin (A) contained in the core portion contains an aliphatic dialcohol having 2 to 5 carbon atoms in an amount of 80 mol % or more.

3. The resin binder for toners according to claim 1, wherein the crystalline polyester is obtained by subjecting the alcohol component containing the aliphatic diol having 2 to 12 carbon atoms and the carboxylic acid component containing the aliphatic dicarboxylic acid compound having 8 to 12 carbon atoms in an amount of from 70 to 100 mol % to polycondensation reaction, cooling the resulting polyester to a temperature of 40° C. or lower, and then heat-treating the polyester at a temperature higher than 40° C. in the range of from an "endothermic maximum peak temperature (° C.) observed in DSC measurement of the polyester− (minus) 40° C." to an "endothermic maximum peak temperature (° C.) observed in DSC measurement of the polyester− (minus) 5° C.".

4. A toner for electrophotography comprising the resin binder for toners as defined in claim 1.

5. The resin binder for toners according to claim 1, wherein the softening point of the non-crystalline resin (B) in the shell portion is lower than the softening point of the non-crystalline resin (A) in the core portion by 10° C. or more.

6. A process for producing a toner, comprising the following steps 1 to 4:

Step 1: mixing an aqueous dispersion containing a crystalline polyester obtained by polycondensing an alcohol component containing an aliphatic diol having 2 to 12 carbon atoms and a carboxylic acid component containing an aliphatic dicarboxylic acid compound having 8 to 12 carbon atoms in an amount of from 70 to 100 mol %, with an aqueous dispersion containing a non-crystalline resin (A) obtained by polycondensing an alcohol component and a carboxylic acid component containing at least one succinic acid compound selected from the group consisting of an alkyl ($C_9$ to $C_{18}$) succinic acid and an alkenyl ($C_9$ to $C_{18}$) succinic acid, and then aggregating the crystalline polyester and the non-crystalline resin (A) to prepare an aqueous solution of resin particles A;

Step 2: preparing an aqueous dispersion containing a non-crystalline resin (B) obtained by polycondensing a carboxylic acid component and an alcohol component containing an aliphatic dialcohol having 2 to 5 carbon atoms in an amount of 80 mol % or more;

Step 3: mixing the aqueous dispersion of the resin particles A prepared in the step 1 with the aqueous dispersion of the non-crystalline resin (B) prepared in the step 2 to aggregate the resin particles A and the non-crystalline resin (B), thereby preparing an aqueous dispersion of resin particles B; and Step 4: coalescing the resin particles B obtained in the step 3 to obtain coalesced particles thereof;

wherein the non-crystalline resin (B) has a softening point lower than a softening point of the non-crystalline resin (A).

* * * * *